US006201943B1

(12) United States Patent
Asakura et al.

(10) Patent No.: US 6,201,943 B1
(45) Date of Patent: Mar. 13, 2001

(54) COLOR IMAGE FORMING APPARATUS AND BELT UNIT AND IMAGE FORMING UNIT THEREOF

(75) Inventors: Kenji Asakura, Katano; Masanori Yoshikawa, Neyagawa; Noboru Katakabe, Uji, all of (JP)

(73) Assignee: Matsushita Electric Industrial, Co., Ltd., Osaka (JP)

( * ) Notice: Subject to any disclaimer, the term of this patent is extended or adjusted under 35 U.S.C. 154(b) by 0 days.

(21) Appl. No.: 09/515,930

(22) Filed: Feb. 29, 2000

Related U.S. Application Data

(62) Division of application No. 09/045,176, filed on Mar. 20, 1998.

(30) Foreign Application Priority Data

Mar. 24, 1997 (JP) ..... 9-069527

(51) Int. Cl.[7] ..... G03G 15/16
(52) U.S. Cl. ..... 399/297; 399/302
(58) Field of Search ..... 399/297, 298, 399/299, 300, 302, 301, 306, 308; 492/48, 53, 54

(56) References Cited

U.S. PATENT DOCUMENTS

| | | | |
|---|---|---|---|
| 5,565,975 | 10/1996 | Kumon et al. | 399/302 |
| 5,640,645 | 6/1997 | Namekata et al. | 399/66 |
| 5,787,326 | 7/1998 | Ogawa et al. | 399/124 |
| 5,809,380 | 9/1998 | Katakabe et al. | 399/227 |
| 5,822,648 | 10/1998 | Mohri | 399/46 |

FOREIGN PATENT DOCUMENTS

| | | | |
|---|---|---|---|
| 54-118832 | * | 9/1979 | (JP) . |
| 07036246 | | 2/1995 | (JP) . |
| 08152812 | | 6/1996 | (JP) . |

* cited by examiner

*Primary Examiner*—Arthur T. Grimley
*Assistant Examiner*—Hoan Tran
(74) *Attorney, Agent, or Firm*—Akin, Gump, Strauss, Hauer & Feld, L.L.P.

(57) ABSTRACT

The average friction factor between the contact surfaces of a drive roller and an intermediate transfer belt is set to not more than 0.45 and not less than 0.1, and before the primary transfer of the toner image of the last color is finished, a cleaning blade is separated from or comes into contact with the intermediate transfer belt with the drive roller as a backup member. The peripheral length of a photoconductor is greater by not more than 10% than the value obtained by dividing the length on a transfer member necessary for a predetermined image length by an integer n which is not less than 3 and not more than 9, and the ratio between the numbers of rotations of the transfer member and the photoconductor is 1:n.

2 Claims, 23 Drawing Sheets

51
58
52
53
55B
55A
59
5
57
50
56
55C
55D
13d
1A
15
13c
1A
9
7
1B
13b
13d
13a
13c
15
7
S
9
13b
13
18
6C
16
6B
13a
64A
5
8
24
14
P
6
38
36
37
34
3Y
3M
3BK
33
19
6A
17
2
30
21
F
35a
35
39
32
3C
3
17
3BK
1
12

COLOR IMAGE FORMING APPARATUS AND BELT UNIT AND IMAGE FORMING UNIT THEREOF

CROSS REFERENCE TO RELATED APPLICATION

This application is a division of copending application Ser. No. 09/045,176, filed Mar. 20, 1998, entitled "Color Image Forming Apparatus and Belt Unit and Image Forming Unit Thereof", the entire disclosure of which is incorporated herein by reference.

BACKGROUND OF THE INVENTION

The present invention relates to a color image forming apparatus applicable to a color printer, a color copier and a color facsimile, etc., and more particularly, to a color image forming apparatus for forming color images by superimposing toner images of a plurality of colors by use of electrophotography, a belt unit and image forming unit of the color image forming apparatus.

As a conventional color image forming apparatus, the one is known which is described in Japanese Laid-open Patent Application No. Hei 8-152812. The structure of relevant parts thereof is shown in FIG. 19 here as an example of conventional image forming apparatuses.

In FIG. 19, a photoconductor 201 is disposed in contact with an intermediate transfer belt 202 and a developer unit 203 containing toner of different colors (yellow, magenta, cyan and black). An exposure device 204 is disposed in a lower part of the figure. The toner image of each color is formed on the photoconductor 201 by a charger 205, signal light 206 from the exposure device 204 and the developer unit 203 of the four colors, and the toner images are transferred color by color onto the intermediate transfer belt 202. The toner remaining on the photoconductor 201 after the transfer is scraped by a photoconductor cleaner 207 which is always pressed against the photoconductor.

The intermediate transfer belt 202 rotates by being supported between a drive shaft 208 and a driven shaft 209 which are rotating. The toner image of each color on the photoconductor 201 is transferred so as to be aligned every time the intermediate transfer belt 202 rotates once, so that a color image in which the toner images of the four colors are superimposed is obtained on the intermediate transfer belt 202. Then, the color image is secondary-transferred onto recording paper 210 by a secondary transfer roller 211, and the toner image is fused by a fuser unit 212, so that a full color image is obtained.

A cleaning blade 214 of a cleaning unit 213 is pressed against the surface of the intermediate transfer belt 202 with the drive shaft 208 as a backup member. After the color image has been transferred onto the recording paper 210, residual toner which remains on the surface of the intermediate transfer belt 202 is scraped by the cleaning blade 124. Thereby, the intermediate transfer belt 202 is cleaned in order to prepare the next image transfer. The cleaning blade 214 of the cleaning unit 213 is structured so as to be separated from the intermediate transfer belt 202 during the above-described color image formation onto the intermediate transfer belt 202.

In the arrangement described in the Japanese Laid-open Patent Application No. Hei 8-152812, in order to prevent a slip on the contact surfaces between the intermediate transfer belt 202 and the drive shaft 208 during the primary transfer when the cleaning blade 214 is not pressed, a resin having high friction factor is applied onto a part or the whole of the contact surfaces.

As a second conventional color image forming apparatus, an arrangement shown in Japanese Laid-open Patent Application No. Hei 7-36246 will be described. FIG. 20 is a side cross-sectional view showing the general structure of the second conventional color image forming apparatus.

In FIG. 20, an intermediate transfer belt unit 301 includes an intermediate transfer belt 302, a first transfer shaft 303, a second transfer shaft 304, a cleaning roller 305, and a waste toner reservoir 306. Color images are superimposed on the transfer belt 302. Image forming units 307Bk, 307Y, 307M and 307C for black, yellow, magenta and cyan, respectively, constitute an image forming unit group 308, and are angularly disposed at the left portion in the body of the apparatus.

The image forming units 307Bk, 307Y, 307M and 307C are mechanically and electrically integrated with the body of the apparatus by being coupled therewith through a non-illustrated inter-coupling member at an image formation position 310 which is opposed to the transfer belt 302. The image forming unit group 308 is structured so as to be rotatable about a generally cylindrical shaft 309 by a drive force of a frame motor. By this rotation, the image forming units 307Bk, 307Y, 307M and 307C are successively placed in the image formation position 310.

A laser exposure device 312 is disposed in a lower part of the body of the apparatus. A laser signal beam 311 is, as shown in the figure, reflected by a mirror 314 in a shaft 309, scans and exposes a photoconductor drum 318 in the image forming unit 307Bk situated at the image formation position 310, and forms an electrostatic latent image. A developer unit 316 forms a black toner image by developing the electrostatic latent image. The toner image is transferred onto the intermediate transfer belt 302. Then, an image forming unit group 308 rotates 90 degrees, so that the yellow image forming unit 307Y is situated at the image formation position 310.

Then, an operation the same as the black image formation process is performed and the yellow toner image is superimposed on the black toner image on the intermediate transfer belt 302. Then, similar operations are performed by use of the magenta and cyan image forming units 307M and 307C, so that the images of the four colors are completed on the intermediate transfer belt 302. Then, the color image is transferred onto recording paper 330 by a transfer roller 319, and lastly, the image is fixed by a fixing unit 320.

In order to obtain highly accurate full color images in a color image forming apparatus, high accuracy is required for the positioning of the images of the four colors. No problem is caused in practical use in the case where the accuracy of positioning of the images of the four colors is not more than 100 $\mu$m. An important point for the positioning is that the periodic speed variations of the photoconductor and the intermediate transfer belt are the same among the images of the colors. Reduction of speed variation of the intermediate transfer belt due to separation and contact of the cleaning blade is also important.

Moreover, since toner images of the four colors are successively formed and superimposed, it takes considerable time to form one sheet of image. It is required to improve the throughput of the color image by reducing the time.

In the arrangement shown in FIG. 19, the cleaning blade is pressed after competition of the primary transfer to the intermediate transfer belt. For this reason, it is necessary that the distance from the primary transfer position to the cleaning position be greater than the image length. Consequently, the peripheral length of the intermediate transfer belt increases, and therefore the time required for one rotation increases. For this reason, the throughput of the image is lowered and it is difficult to reduce the overall size of the apparatus.

Moreover, in the Japanese Laid-open Patent Application No. Hei 7-36246 of the second prior art, no mention is made as to an optimum relationship among the following three: the diameter of the photoconductor which is important for positioning and improvement of the throughput; the peripheral length of the intermediate transfer belt serving as a transfer member; and the image length.

Generally, in order to equalize the speed variations due to eccentricity of rotary members such as the photoconductor and the drive shaft among the colors, the phases of eccentricity of the rotary members are made identical with each other for each color by rotating the rotary members an integral number of times every forming of the image of one color. Thereby, a relationship is obtained that the peripheral length of the intermediate transfer belt is an integral multiple of the peripheral length of the photoconductor.

The diameter of the photoconductor has a low degree of freedom of selection compared with the peripheral length of the intermediate transfer belt. A photoconductor of an appropriate diameter is assumed first. An intermediate transfer belt which is used has a peripheral length which is not less than the sum of the length of the image and the length of a non-image formation section necessary for color switching, and that is an integral multiple of the peripheral length of the photoconductor.

For example, first, it is assumed that the diameter of the photoconductor is 29 mm. Top and bottom margins of 5 mm are set in A4-size recording paper (recording paper with a length of 297 mm) so that the image length is 287 mm. When the non-image formation section necessary for color switching is 85 mm and the peripheral speeds of the photoconductor and the intermediate transfer belt are constant, the necessary peripheral length for the intermediate transfer belt is not less than 372 mm. However in order that the peripheral length of the intermediate transfer belt is an integral multiple of the peripheral length, 91.1 mm, of the photoconductor for the purpose of preventing color displacements due to speed variation, it is necessary that the peripheral length be at least five times, i.e. 455.5 mm. If the length of the intermediate transfer belt is decided as mentioned above, the length of the intermediate transfer belt is considerably long compared with the necessary length 372 mm.

For this reason, the size of the apparatus increases and the rotation period of the intermediate transfer belt increases, so that the throughput of the images of the four colors is lowered. For example, when the running speed of the intermediate transfer belt is 100 mm/second, if the length of the intermediate transfer belt increases by 90 mm, the image formation time for the image of one color increases by 0.9 second. Consequently, for the images of the four colors, the image formation time increases by 3.6 seconds.

Particularly, when the intermediate transfer belt is incorporated in the intermediate transfer belt unit, increase in length of the intermediate transfer belt increases the size of the intermediate transfer belt unit and the size of the body of the apparatus. Moreover, when the photoconductor is incorporated in the image forming unit, increase in diameter of the photoconductor increases the image forming unit. Further, when a plurality of photoconductors are used, increase in diameters of the photoconductors noticeably increases the size of the body of the apparatus. For this reason, it is important to minimize the diameter of the photoconductor and the peripheral length of the intermediate transfer belt. Further, the increase in sizes of the units deteriorates ease of use of the units.

Further, when the photoconductor and the intermediate transfer belt are activated or stopped for each color at the time of switching of the photoconductor, the image quality is liable to degrade if the peripheral length of the intermediate transfer belt is the smallest necessary length. The above-mentioned problems will be described with reference to FIG. 21 to FIG. 23.

FIG. 21 is a view schematically showing the speed of the intermediate transfer belt from the end of image formation of one color to the start of image formation of the next color. Normally, in order to superimpose images on the intermediate transfer belt, it is necessary to detect the position of the intermediate transfer belt 302 and transfer images of a plurality of colors to the same position. For this purpose, for example, position detection means as shown in FIG. 22 is used. A detection hole 302A is provided in the intermediate transfer belt 302, and the position of the intermediate transfer belt 302 is detected by a position detection sensor 321. When the position is detected, a belt position detection signal is generated from the position detection sensor 321. The reference position is detected thereby, and exposure is started in accordance with the timing.

When the speed of the intermediate transfer belt 302 is not stable at the time of the position detection as shown by the broken line V1 of FIG. 21, images written in accordance with a fixed timing are shifted among the colors. For this reason, it is necessary that the movement distance to the position detection be longer than an approach distance until the speed of the intermediate transfer belt becomes constant. The movement distance to the position detection is in a trading-off relationship with the movement distance from the end of image formation to the stop.

FIG. 23 shows a stop position at the image rear end on the intermediate transfer belt 302 at the end of image formation of one color. Here, the distance from a transfer point TP to an image rear end EP is the movement distance from the end of image formation to the stop. A rubbing distance BD is a length where the photoconductor 318 rubs against the intermediate transfer belt 302 at the time of switching of the photoconductor 318.

When the movement distance from the end of image transfer to the intermediate transfer belt 302 to the stop of the intermediate transfer belt 302 is set to be short as shown in the dash and dotted line V2 of FIG. 21 in order to secure a sufficient approach distance at the time of activation, the image rear end stops at a stop position S1 in FIG. 23. In this case, the photoconductor rubs against the rear end of the image on the belt at the time of switching of the photoconductor, so that the image is disturbed.

Conversely, when the distance to the stop is set to be long as shown by the chain double-dashed line V3, the detection hole 302A of the intermediate transfer belt 302 stops at a position S2 of FIG. 22, so that the distance from the position detection sensor 320 is shorter than at a normal stop position S3. For this reason, the belt position detection signal is generated before the speed becomes constant at the time of activation of the intermediate transfer belt 302, so that the positions of the images formed by exposure which is started in accordance with a fixed timing after the generation of the belt position detection signal are shifted from one another on the intermediate transfer belt 302.

BRIEF SUMMARY OF THE INVENTION

To solve the above-mentioned problems, an object of the present invention is to realize size reduction and improvement of the throughput of a color image forming apparatus in which toner images of a plurality of colors are superimposed so as to be accurately aligned on a belt-form image carrier.

To achieve the above-mentioned object, a color image forming apparatus according to an aspect of the present invention comprises: a belt-form image carrier on which a toner image of a different color is formed so as to be aligned every time the belt-form image carrier rotates once; a drive shaft for entraining and rotating the belt-form image carrier; and cleaning means disposed so as to be detachable from and contactable with a portion of the belt-form image carrier which is supported about the drive shaft, after the start of toner image formation onto the belt-form image carrier before the end of toner image formation of the last color.

An image forming apparatus comprises: a belt-form image carrier wherein on a periphery thereof, a toner image is formed so as to be aligned; a drive member about which said belt-form image carrier is supported, said drive member rotating said belt-form image carrier; a driven member about which said belt-form image carrier is supported, said driven member being rotatable by being driven by rotation of said belt-form image carrier; image forming process means disposed so as to be separable from and contactable with said belt-form image carrier, said image forming process means being capable of being situated at a non-working position where said image forming process means is separated from said belt-form image carrier and at a working position where said image forming process means is in contact with said belt-form image carrier; and rotation period difference adjusting means for adjusting so as to fall within a predetermined range a difference between a first rotation period of said belt-form image carrier when said image forming process means is situated at said non-working position and a second rotation period of said belt-form image carrier when said image forming process means is situated at said working position.

A color image forming apparatus comprises: a plurality of image forming units each including a developer unit corresponding to a different color, and a photoconductor; unit moving means for moving said plurality of image forming units between an image formation position and a retracted position; exposure means for exposing said photoconductor of the image forming unit situated at said image formation position; a transfer member for transferring a toner image formed on the photoconductor of the image forming unit situated at said image formation position; and drive means for simultaneously driving said photoconductor of said image forming unit situated at said image formation position and said transfer member when image formation is performed, and for stopping said photoconductor and said transfer member when said image forming unit is moved, when definition is made as A is a predetermined first image length on said transfer member, B is a length, on said transfer member, corresponding to the distance from an exposure position to a transfer position on a periphery of said photoconductor, C is a movement amount of said transfer member during the time from activation of said drive means to start of exposure, D is a movement amount of said transfer member during the time from end of formation of an image of each color to stop of said drive means, w is a ratio of a peripheral speed of said photoconductor to a peripheral speed of said transfer member, n is a ratio of the number of rotations of said photoconductor to the number of rotations of said transfer member by said drive means, said n being an integer, and e is an angle of rotation from said exposure position to said transfer position, a peripheral length LT of said transfer member and a peripheral length LP of said photoconductor fulfill the following two expressions: LT>A+B+C+D and LT=LP×n/W, and a photoconductor diameter d satisfies $$d>(A+C+D)/\{(n-(\theta/360))\pi/w\},$$

said photoconductor diameter d being a value obtained in accordance with each value of n and being a value which minimizes the peripheral length LT of said transfer member.

Moreover, the color image forming apparatus according to the present invention comprises: a plurality of image forming units each including a developer unit corresponding to a different color, and a photoconductor; unit moving means for moving the plurality of image forming units between an image formation position and a retracted position; exposure means for exposing the photoconductor of the image forming unit situated at the image formation position; a transfer member onto which a toner image is transferred which is formed on the photoconductor of the image forming unit situated at the image formation position; and drive means for simultaneously driving the photoconductor of the image forming unit situated at the image formation position and the transfer member when image formation is performed, and for stopping the photoconductor and the transfer member when the image forming unit is moved. The peripheral length LT of the transfer member and the peripheral length LP of the photoconductor satisfy the following expressions:

$$LT>A+B+C+D$$

$$11.1\times(A+B+C+D)\times w/n \geqq LP \geqq (A+B+C+D)\times w/n,$$

where, "A" is a predetermined first image length on the transfer member, "B" is a distance, on the transfer member, corresponding to the distance from an exposure position to a transfer position on the periphery of the photoconductor, "C" is a movement amount of the transfer member from the activation of the drive means to the start of exposure, "D" is a movement amount of the transfer member from the end of formation of an image of each color to the stop of the drive means, "w" is the ratio of the peripheral speed of the photoconductor to the peripheral speed of the transfer member, and "n" is the ratio of the number of rotations of the photoconductor to the number of rotations of the transfer member by the drive means. The ratio n is an integer which is not less than 3 and not more than 9.

A color image forming apparatus according to further aspect of the present invention comprises: a plurality of image forming units each including a developer unit corresponding to a different color, and a photoconductor; unit moving means for moving the plurality of image forming units between an image formation position and a retracted position; exposure means for exposing the photoconductor of the image forming unit situated at the image formation position; a transfer member onto which a toner image is transferred which is formed on the photoconductor of the image forming unit situated at the image formation position; and drive means for simultaneously driving the photoconductor of the image forming unit situated at the image formation position and the transfer member when image formation is performed, and for stopping the photoconductor and the transfer member when the image forming unit is moved. The peripheral length LT of the transfer member and the peripheral length LP of the photoconductor LP satisfy the following expressions:

$$LT>A+B+C+D$$

$$1.1\times(A+B+C+D)\times w/n>LP>(A+B+C+D)\times w/n,$$

where, "A" is a predetermined first image length on the transfer member, "B" is a length, on the transfer member, corresponding to the distance from an exposure position to a transfer position on the periphery of the photoconductor, "C" is a movement amount of the transfer member during the time from the activation of the drive means to the start of exposure, "D" is a movement amount of the transfer member during the time from the end of formation of an image of each color to the stop of the drive means, "w" is the ratio of the peripheral speed of the photoconductor to the peripheral speed of the transfer member, and "n" is the ratio of the number of rotations of the photoconductor to the number of rotations of the transfer member by the drive means. The ratio n is an integer which is not less than 3 and not more than 9.

According to this configuration, when the image of each color is formed by rotating the transfer member once at the time of image formation of each color, the diameter of the photoconductor and the peripheral length of the transfer member can be optimized with respect to a predetermined image length. As a result, the overall size of the apparatus can be reduced, and the throughput of the image can be improved by the reduction in rotation time of the transfer member. Moreover, by making the speed variation of the drive system the same among the colors, the generation of color displacements can be prevented.

Preferably, the peripheral speed ratio w is not less than 0.9 and not more than 1. Thereby, the apparatus can be structured by use of a transfer member having a shorter peripheral length for the same photoconductor diameter. Further, size reduction of the apparatus and improvement of the throughput can be realized. Moreover, a high tolerance of the peripheral length can be secured for nonuniformity and disturbance of the operation while the length necessary for image formation is secured without unnecessary increase of the length of the transfer member, so that high-definition images are obtained with stability.

Preferably, the first image length A is the long-side length of the A3 size and the rotation number ratio n is not less than 4 and not more than 9. According to this configuration, the diameter of the photoconductor and the peripheral length of the transfer member can be optimized for the A3-size recording paper.

Preferably, the first image length A is the long-side length of the A4 size and the rotation number ratio n is not less than 3 and not more than 7. According to this configuration, the diameter of the photoconductor and the peripheral length of the transfer member can be minimized for the A4-size recording paper.

The color image forming apparatus further comprises determination means for determining the image length to be output, and sequence switching means for switching the image forming sequence. A length E is defined as a contact length between the transfer member and the photoconductor which are in contact with each other when the image forming unit is moved. When the determination means determines that the image length to be output is a second length which is longer than the first image length A on the transfer member and shorter than a value obtained by subtracting the contact length E from the peripheral length LP of the photoconductor, preferably, the sequence switching means switches the image forming sequence and forms the image of each color by rotating the transfer member twice at the time of image formation of each color. According to this configuration, the apparatus can be structured by use of a transfer member having a shorter peripheral length for the same photoconductor diameter. As a result, a full color image of the second image length which is longer than the first image length can be output with a small-size apparatus without lowering of the throughput of the full color image of the first image length. Moreover, for the transfer member of the same peripheral length, a high tolerance can be secured for nonuniformity and disturbance of the length necessary for image formation, so that high-definition images can be obtained with stability.

Preferably, the first image length A is the long-side length of the A4 size and the second image length is the long-side length of the legal size. According to this configuration, a full color image of the legal-size image length which is longer than the A4-size image length can be output without lowering of the throughput of the full color image of the A4-size image length.

Preferably, the peripheral length LT is not less than 330 mm and not more than 400 mm and the outside diameter of the photoconductor is not less than 15 mm and not more than 32 mm.

Preferably, the peripheral speeds of the photoconductor and the transfer member are constant and the peripheral length L of the transfer member is 377 mm. According to this feature, an optimum combination can be realized for a photoconductor with a diameter of 30 mm or 24 mm which is easy to get, so that the overall size of the apparatus can be reduced, and the throughput of the image can be improved by the reduction in rotation time of the transfer member. Moreover, it is possible to make the same the speed variations of the photoconductor and the transfer member each color, so that the generation of color displacements can be prevented.

Preferably, the rotation angle from the exposure position to the transfer position on the periphery of the photoconductor of the image forming unit situated at the image formation position is greater than 170 degrees and smaller than 180 degrees. Thereby, the peripheral length of the photoconductor from exposure to transfer is reduced. Since the apparatus can be structured by use of a transfer member having a shorter peripheral length for the same photoconductor diameter, size reduction of the apparatus and improvement of the throughput can be realized. Moreover, a high tolerance of the peripheral length can be secured for nonuniformity and disturbance of the operation while the length necessary for image formation is secured without unnecessary increase of the peripheral length of the transfer member, so that high-definition images are obtained with stability.

Preferably, the transfer member is an intermediate transfer belt which is supported by a plurality of support shafts. According to this configuration, the limit to the thickness and length of the recording paper is small, so that a variety of recording paper can be used. Moreover, since the freedom degree of selection of the running path of the intermediate transfer belt is large, the size of the apparatus can be reduced.

Preferably, the intermediate transfer belt is supported about the support shafts in an area which is opposed to the image forming unit situated at the image formation position. Moreover, when the unit moving means moves a plurality of image forming units, the image forming units are moved with the photoconductor and the intermediate transfer belt rubbing against each other of the length where. Preferably, in a rubbing length, the length from the transfer point where the photoconductor and the intermediate transfer belt come into contact with each other on the downstream side in the running direction of the intermediate transfer belt is shorter than the movement amount of the intermediate transfer belt after the end of image formation of each color before the drive means is stopped. According to this configuration, the image forming unit which is moving does not rub against the rear end of the image even if the intermediate transfer belt is stopped after the end of image formation of one color. As a result, a high tolerance can be secured for nonuniformity and disturbance of the operation while the length necessary for image formation is secured without unnecessary increase of the peripheral length of the transfer member, so that high-definition images are obtained with stability. Moreover, since the contact pressure between the intermediate transfer belt and the photoconductor can be restrained, damage is prevented due to friction between the photoconductor and the intermediate transfer belt.

Preferably, the rubbing length from the image formation position on the upstream side in the running direction of the intermediate transfer belt is longer than the rubbing length on the downstream side. According to this configuration, the entrance distance at the time of activation which is necessarily longer than at the time of deactivation can be secured without increase of the peripheral length of the intermediate transfer belt. Thereby, the apparatus can be structured by use of an intermediate transfer belt having a shorter peripheral length for the same photoconductor diameter. As a result, size reduction of the apparatus and improvement of the throughput can be realized. Moreover, a high tolerance of the peripheral length can be secured for nonuniformity and disturbance of the operation while the length necessary for image formation is secured without unnecessary increase of the peripheral length of the transfer member, so that high-definition images are obtained with stability.

Preferably, the moving path of the photoconductor when the image forming unit is moved is circular. Preferably, the direction of entrainment of the intermediate transfer belt which is supported opposed to the photoconductor of the image forming unit situated at the image formation position is inclined from the tangential line of the envelope of the periphery of the circular movement path of the photoconductor toward the center of the circular movement path of the photoconductor on the upstream side in the running direction of the intermediate transfer belt. According to this configuration, the rubbing length from the image formation position on the upstream side in the running direction of the intermediate transfer belt can be set to be longer than the rubbing length on the downstream side.

Preferably, the intermediate transfer belt is detachable from the body of the apparatus together with the support shafts. According to this configuration, the intermediate transfer belt and the support shafts can be used as one unit, so that maintenance such as replacement of the intermediate transfer belt and disposal of the waste toner is facilitated and the reliability of the apparatus is improved.

Preferably, the image forming unit is detachable from the body of the apparatus. According to this configuration, maintenance such as replenishment of toner, replacement of the photoconductor and disposal of the waste toner is facilitated and the reliability of the apparatus increases.

A belt unit according to the present invention is detachable from the above-described color image forming apparatus. According to this embodiment, size reduction of the apparatus and improvement of the throughput are realized, so that excellent images are obtained in which there is no positional shift and maintenance is facilitated.

The image forming unit according to the present invention is detachable from the above-described color image forming apparatus. According to this configuration, size reduction of the apparatus is enabled, maintenance such as replenishment of toner, replacement of the photoconductor and disposal of the waste toner is facilitated, and the reliability of the apparatus is improved.

DETAILED DESCRIPTION OF THE INVENTION

Hereinafter, preferred embodiments of the present invention will be described with reference to FIG. 1A to FIG. 18.

[First Embodiment]

Figures 1A, 1B, 1C:
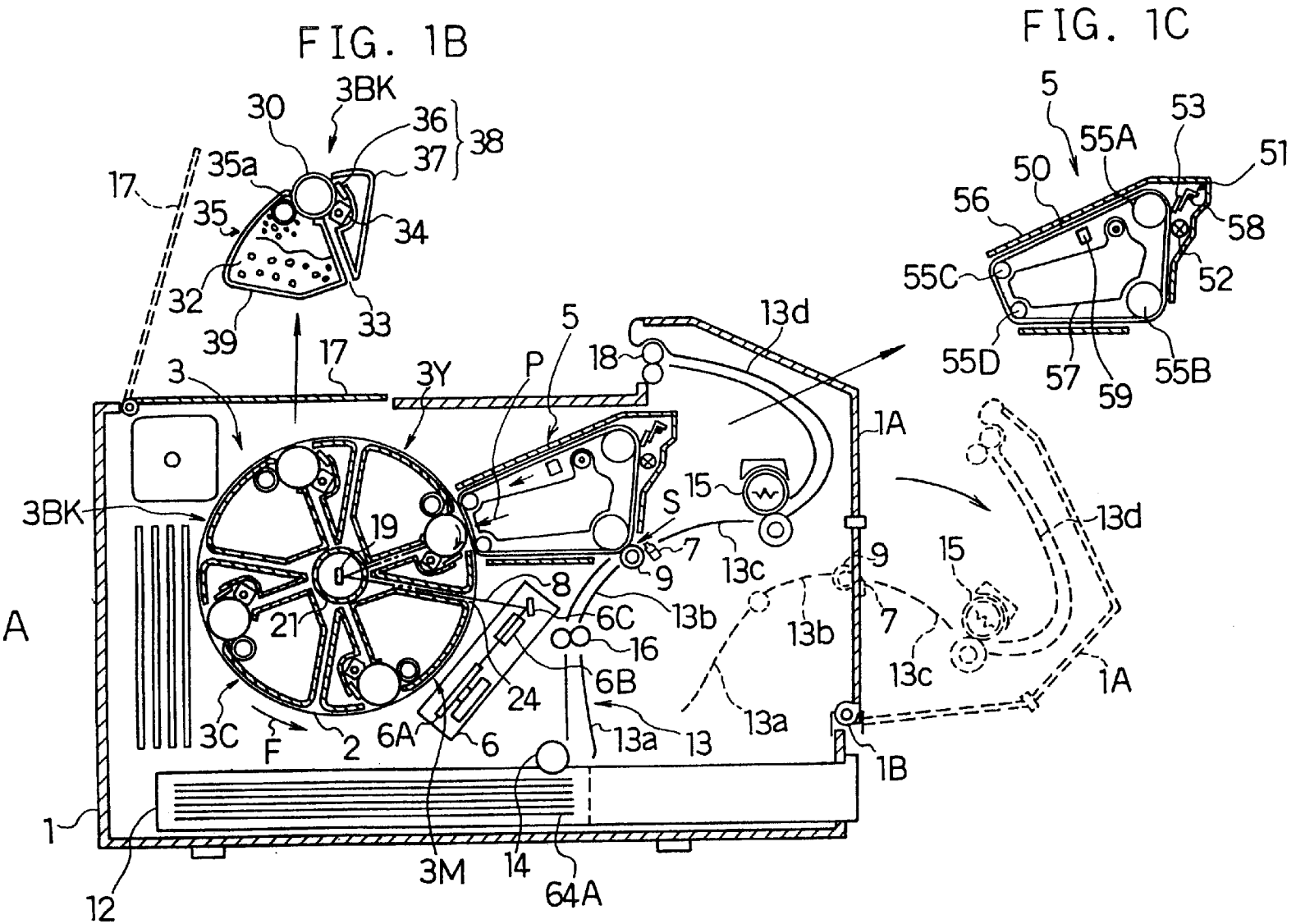
FIG. 1A is a side cross-sectional view showing a color image forming apparatus according to a first embodiment of the present invention.
FIG. 1B is a side cross-sectional view showing an image forming unit.
FIG. 1C is a side cross-sectional view showing a belt unit.
Figure 2:
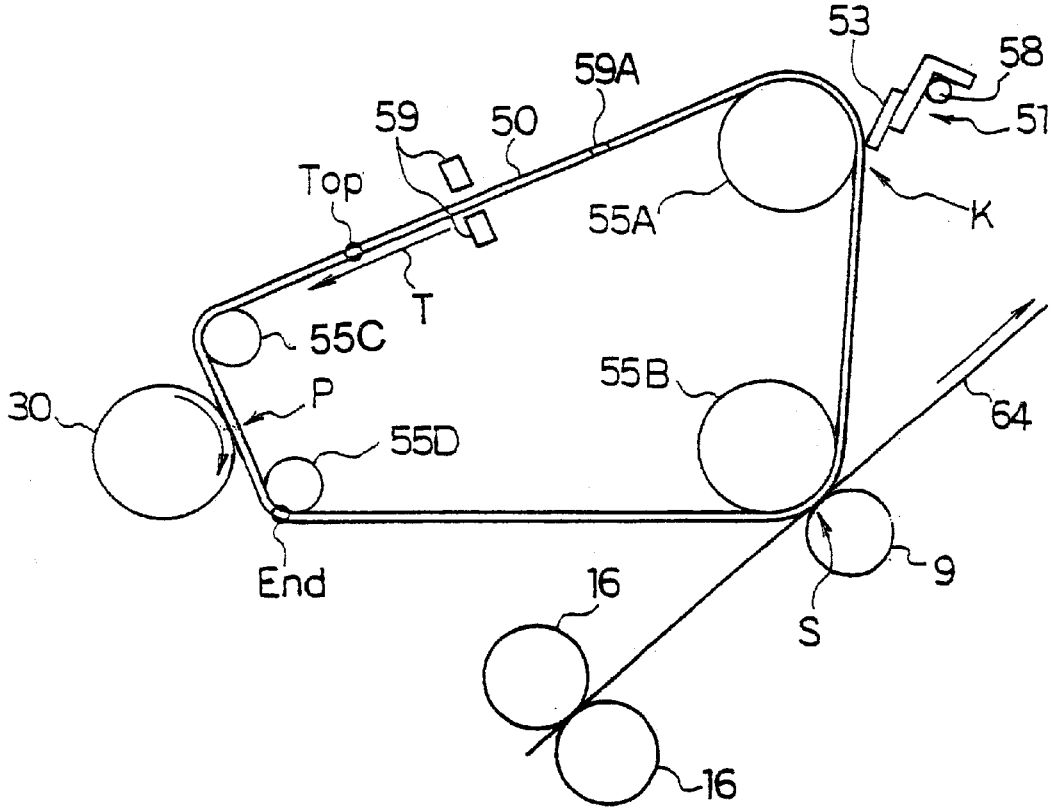
FIG. 2 is a side view showing relevant parts of an intermediate transfer belt in the first embodiment of the present invention.

First, a color image forming apparatus according to the first embodiment of the present invention will be described with reference to FIG. 1A to FIG. 11. FIG. 1A is a side cross-sectional view showing the structure of the color image forming apparatus according to the first embodiment of the present invention. FIG. 1B is a side cross-sectional view showing an image forming unit 3Bk. FIG. 1C is a side cross-sectional view showing a transfer belt unit 5. FIG. 2 is an enlarged side view showing the positions of an intermediate transfer belt 50, a photoconductor 30, a cleaner 51, and a secondary transfer roller 9.

First, the image forming unit 3Bk shown in FIG. 1B will be described. Image forming units 3Y, 3M, 3C and 3Bk for yellow, magenta, cyan and black, respectively, shown in FIG. 1A have the same structure. Therefore, the black image forming unit 3Bk will be described in detail and no descriptions will be given as to the yellow, magenta and cyan image forming units 3Y, 3M and 3C.

The image forming unit 3Bk is a combination of subsequently-described process elements disposed around the photoconductor 30. The photoconductor 30 which is an aluminum drum having an organic photoconductive layer, which uses phthalocyanine as the photoconductive material, and is formed chiefly of polycarbonate binder resin. A charger 34 charges the photoconductor 30. Laser beams enter through an exposure window 33 of the image forming unit 3.

An image forming unit 3Bk for black comprises a toner hopper 39, a development roller 35*a* and the like. The toner hopper 39 contains negatively chargeable toner 32Bk for black. The cleaner 38 has a rubber-made cleaning blade 36 and a waste toner reservoir 37, and cleans toner off the surface of the photoconductor 30. The photoconductor 30 which is 30 mm in diameter and the development roller 35*a* which is 18 mm in diameter are both held so as to be rotatable.

Toner images formed on the photoconductor 30 at an image formation position 10 shown in FIG. 1A are successively transferred onto the intermediate transfer belt 50 in the transfer belt unit 5 so as to be superimposed. The toner images on the intermediate transfer belt 50 are secondary-transferred onto recording paper 64. The transfer belt unit 5 includes the intermediate transfer belt 50 integrally formed therewith, rollers 55A, 55B, 55C and 55D about which the belt 50 is supported, the cleaner 51, and a waste toner case 57 for holding waste toner. The transfer belt unit 5 is detachable from a body 1 of the apparatus.

The intermediate transfer belt 50 is formed of endless-belt-form semi-conducting (intermediate resistance) polycarbonate resin with a thickness of 150 $\mu$m. The intermediate transfer belt 50 has a detection hole 59*a* shown in FIG. 2 in order to coincide the writing start positions of toner images of the colors with one another on the intermediate transfer belt 50. The peripheral length of the intermediate transfer belt is set to 377 mm which is the sum of the long-side length (297 mm) of A4-size recording paper and a length slightly longer than one-half of the peripheral length of the photoconductor 30 (30 mm in diameter). The width of the intermediate transfer belt 50 is approximately 250 mm.

A position detection sensor 59 detects passage of the detection hole 59*a*. When the intermediate transfer belt 50 is stopped with a non-image formation section of the intermediate transfer belt 50 being opposed to the photoconductor 30 as shown in FIG. 2, the distance between the detection hole 59*a* and the position detection sensor 59 is set to 50 mm which is longer than the distance necessary for the motor to reach a constant speed after start of rotation.

In FIG. 1C, the cleaner 51 is provided for cleaning residual toner off the intermediate transfer belt 50. The cleaner 51 comprises a rubber-made cleaning blade 53, and a screw 52 for conveying scraped toner into the waste toner case 57. A fur brush is usable as replacement for the cleaning blade. The pushing force of the cleaning blade-to the intermediate transfer belt 50 is set to 20 gf/cm.

While color images are being formed on the intermediate transfer belt 50, in order that the toner images on the intermediate transfer belt 50 are not scraped, the cleaner 51 is separated from the intermediate transfer belt 50 by being rotated about a fulcrum 58. The intermediate transfer belt 50 is covered with a protective cover 56.

The roller 55A about which the intermediate transfer belt 50 is supported is a drive roller driving the intermediate transfer roller by friction owing to rotation operation from the body side. The roller 55A also serves as a backup member for the cleaner 51. The periphery of the drive roller 55A which is in contact with the intermediate transfer belt 50 is formed of a metal, preferably aluminum, having a low factor of friction compared with rubber and resin. The surface roughness of the periphery of the drive roller 55A is Ra 1.6 $\mu$m.

The backup roller 55B acts as a backup member for the secondary transfer roller 9 for transferring toner images on the intermediate transfer belt 50 onto the recording paper 64. The roller 55C is a guide roller. The tension roller 55D provides the intermediate transfer belt 50 with tension, and applies to the intermediate transfer belt 50 a primary transfer bias for transferring toner images from the photoconductor 30 to the intermediate transfer belt 50. The intermediate transfer belt 50 is provided with a constant tension of 3 kgf by the tension roller 55D. The backup roller 55B, the guide roller 55C and the tension roller 55D are formed of a similar material to the drive roller 55A, and is supported by a belt side plate 61 (FIG. 3) as driven rollers which are rotatable by rotation of the intermediate transfer belt 50. The angle of entrainment of the intermediate transfer belt 50 about the drive roller 55A is approximately 120 degrees which is the greatest among the rollers. The angle of entrainment of the intermediate transfer belt 50 can be selected in the range of 90 to 180 degrees.

In order that the rollers rotate an integral number of times while the intermediate transfer belt 50 rotates once, the diameters of the drive roller 55A and the backup roller 55B are 30 mm, and the diameters of the guide roller 55C and the tension roller 55D are 20 mm.

[Structure of Apparatus]

In FIG. 1, the right end face is the front face of the body 1, and a carriage 2 is disposed to the left of the body 1. A front door 1A is provided on the front face of the body 1, and a top door 17 is provided on the top surface of the body 1.

A paper feeding unit 12 holds the recording paper 64A. The recording paper 64A is sent out by a paper feeding roller 14 and resist rollers 16 to a secondary transfer position S where the secondary transfer roller 9 and the intermediate transfer belt 50 come into contact with each other in accordance with the timing of image formation onto the intermediate transfer belt 50. The recording paper 64 is sent by paper guides 13*a,* 13*b,* 13*c* and 13*d* and paper discharging rollers 18, and is discharged out of the apparatus through the secondary transfer position S and a fixing unit 15 as shown by the broken line.

The recording paper 64 of A4 size (297 mm in long-side length) is set in the paper feeding unit 12. In this embodiment, the image length is 287 mm in consideration of top and bottom margins of 5 mm for the length of the recording paper 64.

The carriage 2 holds the image forming units 3Y, 3M, 3C and 3BK for the four colors. The carriage 2 is rotatably supported by a circular tube 21, and moves the photoreceptor drum 30 of each color between the image formation position P and a retracted position. The center of rotation of the carriage 2 is in a direction vertical to the running direction of the intermediate transfer belt 50 in the transfer section.

The image forming unit 3 shown in FIG. 1B is detachable from the carriage 2 from outside the body 1 by opening the top door 17. The image forming unit 3 is connected to the drive source and the power source of the body 1 and performs image formation only at the image formation position P where the photoconductor 30 comes into contact with the transfer belt unit 5. The image forming units 3 situated at the retracted positions do not operate.

The front door 1A is coupled to the body 1 by a hinge 1B, and is openable by being tilted toward the front (toward the right in the figure). To the front door 1A is attached a fixing unit 15, the secondary transfer roller 9, a charge removing needle 7 for removing the charge of recording paper, the paper guides 13C and 13D, and the front surface side of the paper guide 13. When the front door 1A is tilted toward the front, these members are tilted together with the front door 1A. Consequently, the front surface of the body 1 is largely opened, so that the transfer belt unit 5 can be attached or detached through this portion. When paper jam occurs, jammed recording paper can be easily removed through this portion.

When attached to the body 1, the transfer belt unit 5 is placed in position, so that the portion of the transfer belt unit 5 which is opposed to the image formation position P comes into contact with the photoconductor 30. Concurrently therewith, the transfer belt unit 5 is electrically connected to the body 1, and the drive roller 55A is engaged with drive means on the side of the body 1, so that the intermediate transfer belt 50 becomes rotatable.

An exposure device 6 is disposed below the transfer belt unit 5, and comprises a semiconductor laser (not shown), a polygon mirror 6A, a lens system 6B and a first mirror 6C. A laser beam 8 passes along an optical path 24 formed between the image forming unit 3Y and the magenta image forming unit 3M of FIG. 1A. Then, the laser beam 8 passes through an exposure window (not shown) formed in a part of the circular tube 21, and is made incident on a mirror 19. Then, the laser beam 8 is reflected by the mirror 19, and is made incident on a photoconductor 30Y of the image forming unit 3Y situated at the image formation position P. The photoconductor 30Y is exposed by being scanned in the direction of generatrix by the laser beam 8.

In FIG. 2, the rotation direction of the photoconductor 30 is shown by an arrow, the rotation direction of the intermediate transfer belt 50 is shown by the arrow T. In FIG. 1, and the rotation direction of the carriage 2 is shown by the arrow F.

The intermediate transfer belt 50 is pressed against the photoconductor 30 situated at the image formation position P with a bite of 1 mm at a portion between the tension roller 55D and the guide roller 55C. The image forming unit 3 is fixed within the carriage 2 and hardly moves. Therefore, at the time of unit switching, the photoconductor 30 of the image forming unit 3 rubs against the supported intermediate transfer belt 50 for approximately 10 mm. That is, since the running direction of the intermediate transfer belt 50 coincides with the tangent line direction of the rotation circle of the carriage 2 when the carriage 2 rotates, the rubbing distance is 10 mm both when the photoconductor 30 enters the image formation position P and when the photoconductor 30 leaves the image formation position P.

Figure 3:
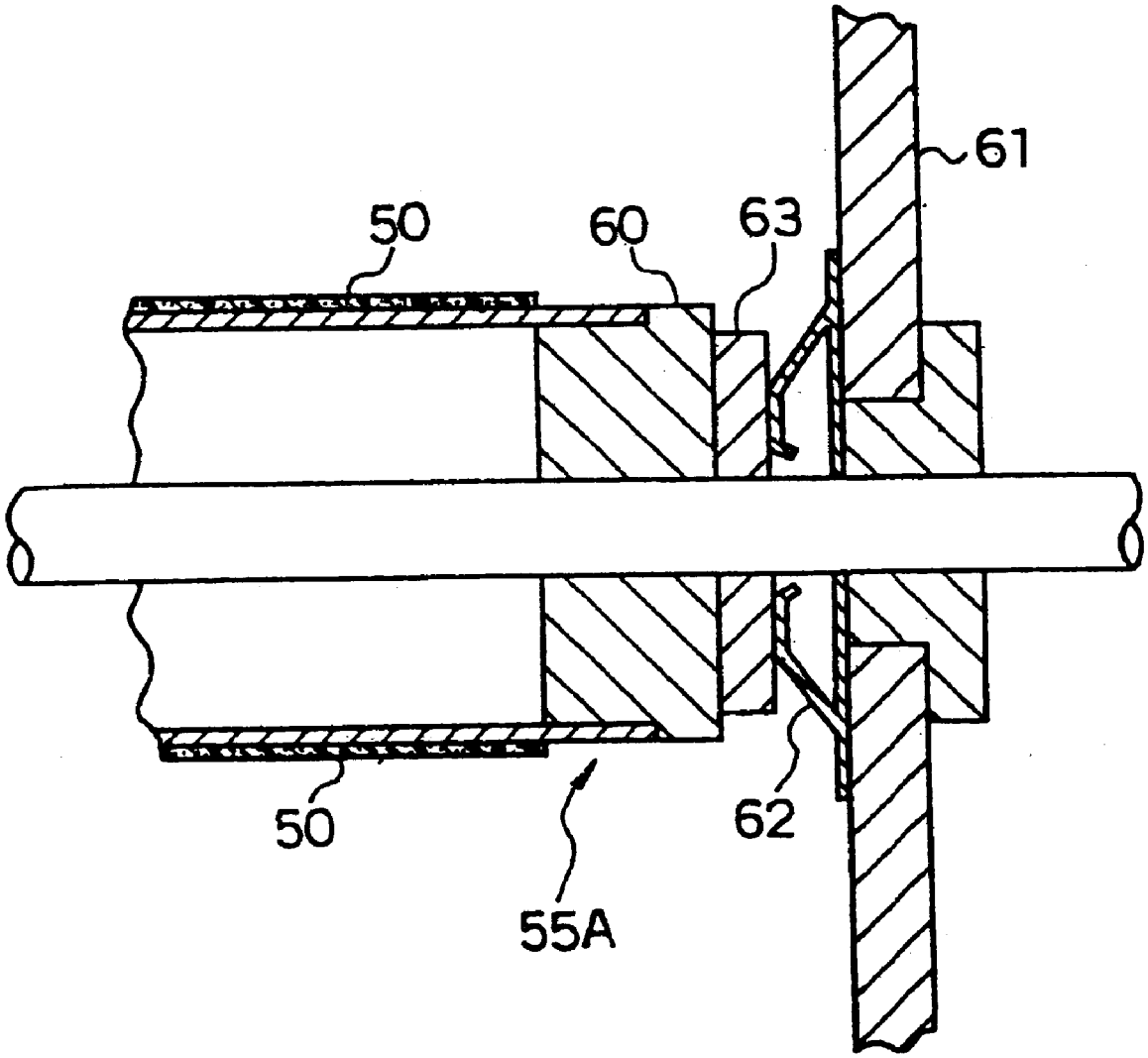
FIG. 3 is a cross-sectional view showing an end portion of a drive roller in the first embodiment of the present invention.

FIG. 3 is a cross-sectional view showing an end portion of the drive roller 55A. A drive flange 60 at the end portion of the drive roller 55A has a friction pad 63, and a spring 62 on the belt side plate 61 for supporting the rollers 55A, 55B, 55C and 55D imposes a constant friction load of 800 gf-cm on the friction pad 63 by pushing against the friction pad.

Figure 4:
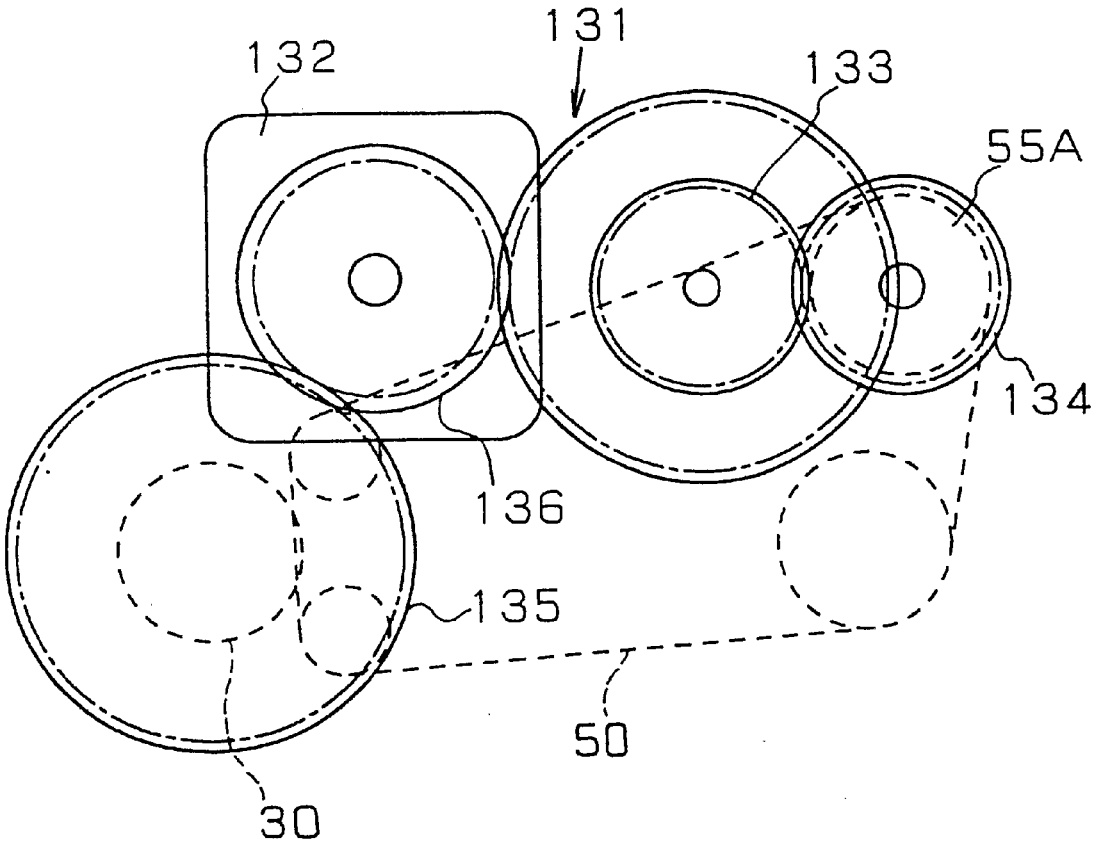
FIG. 4 is a side view showing relevant parts of a drive mechanism in the first embodiment of the present invention.

FIG. 4 is a side view showing relevant parts of a drive mechanism of the photoconductor 30 and the intermediate transfer belt 50. A drive mechanism 131 comprises a motor 132, a belt drive gear 133, a belt gear 134 integrally formed with the drive shaft 55A, a photoconductor drive gear 135, and a motor gear 136. The photoconductor gear 135 and the belt drive gear 133 are coupled into a single drive system. The number of teeth of each gear is set so that the gear rotates exactly an integral number of times during one rotation of the intermediate transfer belt 50. When the transfer belt unit 5 is attached to the body 1, the belt drive gear 133 on the side of the body 1 engages with the belt gear 134 of the belt unit 5, so that drive force is transmitted.

Figure 5:
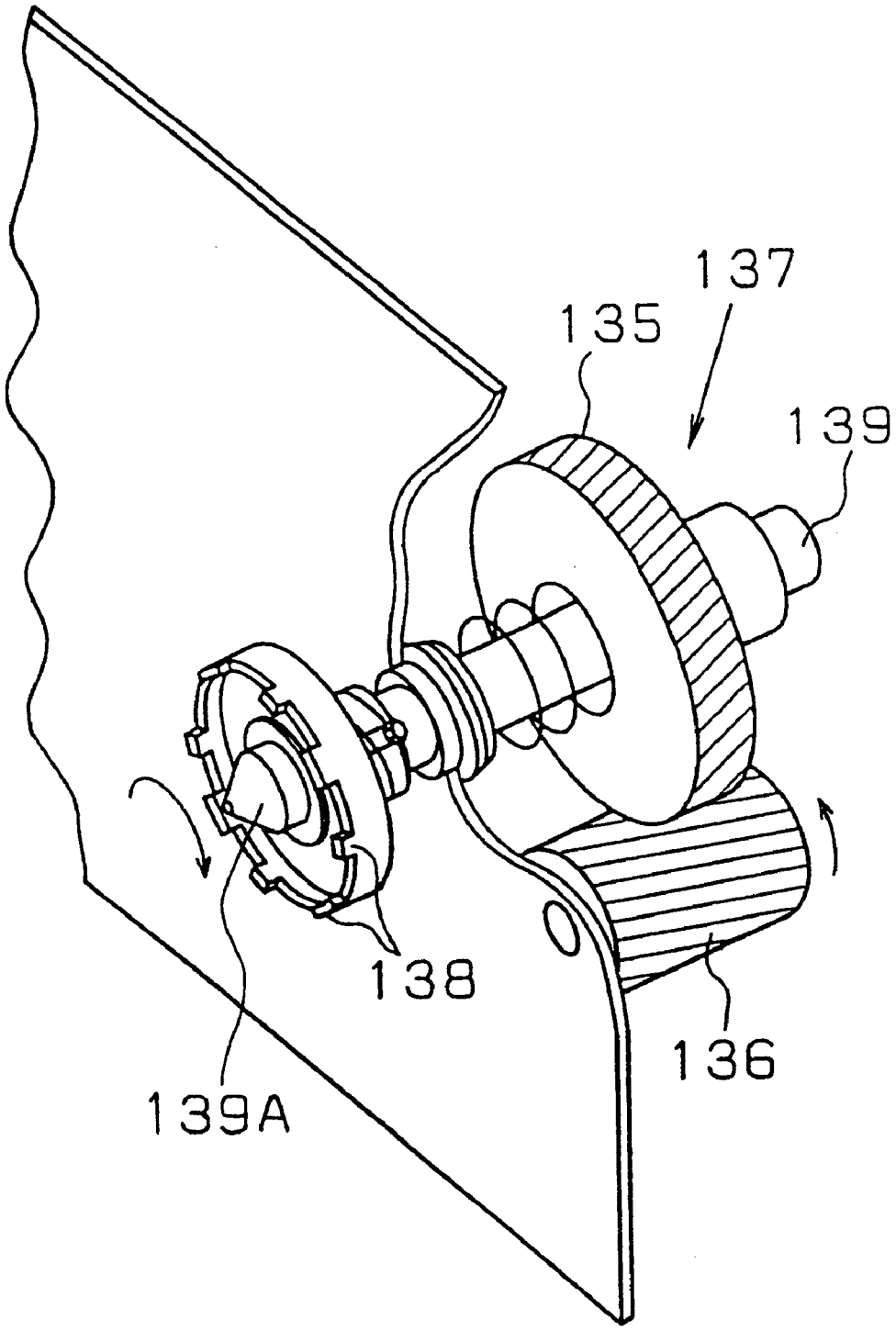
FIG. 5 is a perspective view showing a coupling mechanism in the first embodiment of the present invention.

FIG. 5 is a perspective view showing the structure of a coupling mechanism 137 on the side of the body 1 for transmitting drive force to the photoconductor 30. A claw 138 is secured to a coupling shaft 139. By pressing a tapered portion 139A at the front end of the coupling shaft 139 into a tapered hole (not shown) formed at an end portion of the photoconductor 30, the coupling shaft 139 becomes substantially coaxial with the photoconductor 30 situated at the image formation position P, so that the photoconductor 30 is positioned. The claw 138 on the circumference moves in the axial direction together with the coupling shaft 139, and engages with an uneven portion of a coupling bearing (not shown) having a configuration substantially similar to the claw 138 provided on the photoconductor 30 situated at the image formation position P, so that drive force is transmitted to the photoconductor 130. In this embodiment, the process speed is approximately 100 mm/second.

A color image forming process will be described hereafter.

Figure 6:
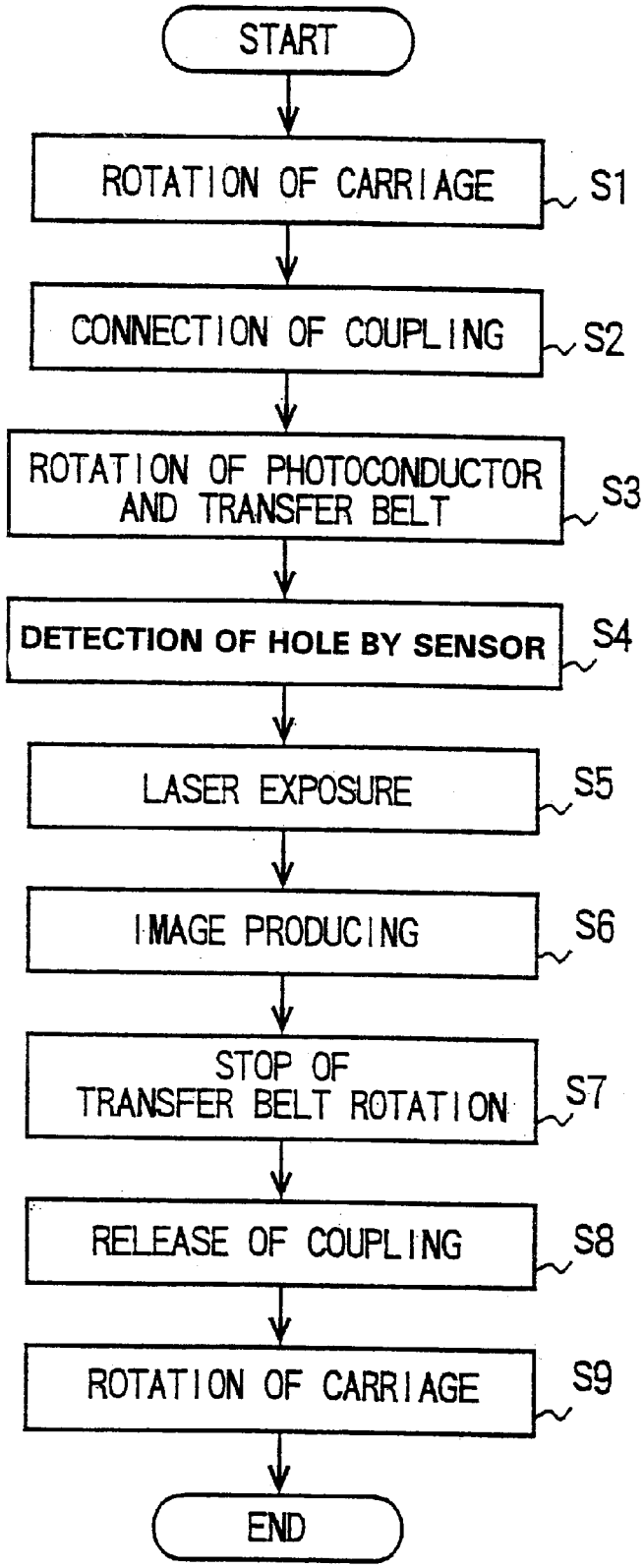
FIG. 6 is a flowchart of an image forming unit switching operation in the first embodiment of the present invention.

FIG. 6 is a flowchart showing the operation sequence from the start of rotation of the carriage 2 for switching of the image forming unit to the next switching of the image forming unit after the formation of a toner image of one color.

When the power of the image forming apparatus is turned on with the transfer belt unit 5 and the image forming unit 3 for each color being attached to the predetermined positions of the body 1, the fixing unit 15 is increased in temperature, so that the yellow image forming unit 3Y is placed in the image formation position P (step S1 of FIG. 6). Moreover, a polygon mirror 6A of the laser exposure device 6 starts rotating for preparation.

When the preparation is completed, a yellow image forming process is started first.

After the image forming unit 3 is positioned and the coupling shaft 139 is coupled (step S2), the drive mechanism 131 rotates the drive roller 55A and the photoconductor 30 (step S3). The drive roller 55A rotates the intermediate transfer belt 50 in the direction of the arrow T. The time from the activation of the rotation to the stabilization of the rotation speed is approximately 0.2 second. During this time, the intermediate transfer belt 50 runs approximately 10 mm. By the running of the intermediate transfer belt 50, the detection hole 59*a* on the intermediate transfer belt 50 passes the position detection sensor 59, so that a detection signal is generated (step S4). The time from the activation of the drive mechanism 31 to the position detection is 0.3 second.

The charger. 34 charges the surface of the photoconductor 30 to −450 V concurrently with the rotation of the photoconductor 30. At this time, the secondary transfer roller 9 and the cleaner 51 are separated from the intermediate transfer belt 50.

In order that the image is transferred to a predetermined position on the intermediate transfer belt 50, the laser signal beam 8 corresponding to the image information is applied to the photoconductor 30 after 0.1 second from the generation of the position detection signal (step S5), so that an electrostatic latent image with an exposure potential of −50 V is formed on the photoconductor 30. The time from the activation of the drive mechanism 31 to the start of exposure by the laser signal beam 8 is 0.4 second, and during this time, the intermediate transfer belt 50 runs 30 mm. A voltage of −250 V is applied to the development roller 35*a*. The electrostatic latent image is developed by the development roller 35*a*, so that a yellow toner image is formed on the photoconductor 30 (step S6). The yellow toner image is transferred onto the intermediate transfer belt 50 by a voltage of +1.0 kV applied to the tension roller 55D, in a primary transfer section where the photoconductor 30 and the intermediate transfer belt 50 come into contact with each other.

After the yellow toner image has been all transferred, the drive mechanism 31 is stopped when a portion of the intermediate transfer belt 50 where no image is to be formed comes to a position opposite to the photoconductor 30 (step S7). In this operation, the intermediate transfer belt 50 rotates exactly once and returns to its initial position during the yellow image formation. The intermediate transfer belt 50 runs approximately 10 mm during the time from when the rear end of the image passes a transfer nip and image recording is finished to when the intermediate transfer belt 50 stops. At this time, as shown in FIG. 2, an image front end position (Top) passes a cleaning position K, and an image rear end position (End) is situated upstream from the cleaning position K.

After the drive mechanism 131 is stopped, the coupling between the photoconductor 30 and the coupling 137 is released (step S8). Then, the carriage 20 is rotated 90 degrees in the direction shown by the arrow F, so that the image forming unit 3 situated at the image formation position P is switched from the image forming unit 3Y to the image forming unit 3M (step S9). At the time of the switching, the image forming unit 3M is moved with the photoconductor 30 of the image forming unit 3M being rubbed against the non-image formation section of the intermediate transfer belt 50. After the rotation of the carriage 2 is finished, the coupling 137 is coupled to the image forming unit 3M situated at the image formation position P. This enables the transmission of drive force to the photoconductor 30.

Then, the image forming unit 3M and the transfer belt unit 5 start operating, and magenta toner image formation is performed in a similar manner to the transfer of yellow images. Consequently, yellow and magenta toner images are superimposed on each other being positioned on the intermediate transfer belt 50.

By successively performing the above-described operation for cyan and black, the toner images of the four colors are superimposed so as to be positioned on the intermediate transfer belt 50. During the primary transfer of the black toner image, after the rear end of the toner image in which the yellow, magenta and cyan toner images are superimposed passes the secondary transfer position S, the secondary transfer roller 9 is moved and pressed against the intermediate transfer belt 50 before the front end of the toner image in which the black toner image is also superimposed reaches the secondary transfer position S. Then, in accordance with the timing for the four-color-superimposed toner image to reach the secondary transfer position S, the recording paper 64 sent out by the resist rollers 14 is conveyed by being held between the secondary transfer roller 9 and the intermediate transfer belt 50. Consequently, the four-color-superimposed toner image is transferred onto the recording paper. At this time, a voltage of +700 V is applied to the secondary transfer roller 9. The recording paper 64 onto which the toner image has been transferred is fixed by passing through the fixing unit 15, and is discharged out of the apparatus by the paper discharging rollers 18.

During the primary transfer of the black toner image, after the rear end of the toner image in which the yellow, magenta and cyan toner images are superimposed passes the cleaning position K, the cleaner 51 is moved and pressed against the intermediate transfer belt 50 before the front end of a residual toner image after the secondary transfer reaches the cleaning position. Thereby, the toner remaining on the intermediate transfer belt 50 after the secondary transfer is scraped by the cleaning blade 53. The waste toner being scraped is sent into the waste toner case 57 by the screw 52. Since the distance between the cleaning position K and the image formation position P of the primary transfer is shorter than the image length, the primary transfer of the image of the last color has not been finished yet when the cleaner 51 is pressed.

When only one sheet of image is formed, after all the residual toner after the secondary transfer passes the cleaning position K, the intermediate transfer belt 50 and the image forming unit 3 stop operating, so that the secondary transfer roller 9 and the cleaner 51 are separated from the intermediate transfer belt 50. Then, the carriage 2 is rotated 90 degrees, so that the yellow image forming unit 3Y again returns to the image formation position P and the color image formation is completed.

When images are continuously formed, with the cleaner 51 and the secondary transfer roller 9 being pressed against the intermediate transfer belt 50, image formation of the first color of the next image is performed by the black image forming unit 3BK situated at the image formation position P. Then, the image is transferred to a position where the previous image was transferred on the intermediate transfer belt 50. The cleaner 51 and the secondary transfer roller 9 are separated from the intermediate transfer belt 50 before the front end of the toner image of black which is the first color of the second sheet of image reaches the cleaning position K and the secondary transfer position S. Then, after the black image is formed, the yellow image forming unit 3Y is placed in the image formation position P, and the above-described image formation is performed. Then, by repeating the above-described operation so that the images of the next and succeeding colors are superimposed on the intermediate transfer belt 50, a color image is obtained.

According to this embodiment, since cleaning is performed while primary transfer is performed, the peripheral length of the intermediate transfer belt 50 can be minimized, so that the size of the apparatus can be reduced and the throughput can be improved.

In the above-described arrangement, it becomes a problem that there is a difference in running speed (rotation period) of the intermediate transfer belt 50 between when the cleaner 51 is pressed against the intermediate transfer belt 50 and when the cleaner 51 is separated therefrom. This difference is caused by variation in speed of the intermediate transfer belt 50 due to the pressing by the cleaning blade 53. A positional shift is caused between a toner image formed with the cleaner 51 not being pressed and a toner image formed with the cleaner 51 being pressed. The smaller the difference is, the more stably the intermediate transfer belt 50 runs, so that excellent images are obtained in which there is no positional shift.

Since the image forming unit 3Y of the first color (yellow in this embodiment) is not returned to the image forming position P but image formation is continuously performed by use of the image forming unit of the last color (black in this embodiment) of the previously formed image as the first color of the second and succeeding sheets of images, the throughput is improved when a plurality of sheets of images are formed. In this case, the cleaner 51 is separated from the intermediate transfer belt 50 during the primary transfer of the image of the first color of the second and succeeding sheets of images. For this reason, it is important for preventing the positional shift that the difference in running speed of the intermediate transfer belt 50 is small between when the cleaner 51 is pressed against the intermediate transfer belt 50 and when the cleaner 51 is separated therefrom.

In the transfer belt unit 5 of this embodiment, the friction torque of the drive roller 55A is approximately b 4kgf-cm when the drive roller 55A is slidingly rotated with the intermediate transfer belt 50 being fixed. Therefore, the maximum frictional force is 2.7 Kgf. Preferably, the maximum frictional force is within the range of 2.5 Kgf to 6.0 Kgf, and the tension of the intermediate transfer belt 50 is within the range of 2 Kgf to 4 Kgf.

When the maximum frictional force is F, the tension of the intermediate transfer belt 50 is T, the average friction factor between the contact surfaces is $\mu$ and the angle of entrainment of the intermediate transfer belt 50 about the drive roller 55A is $\theta$, the relationship of the following expression holds from the Eytel wein's expression (1) relating to the belt transmission described in a document (e.g. "Mechanical Design", vol. 33, 16th issue, p. 93).

$$(F+T)/T=\exp(\mu*\theta) \quad \ldots (1)$$

The average friction factor between the drive roller 55A and the intermediate transfer belt 50 is obtained from the expression (1). In the arrangement shown in this embodiment, $\mu$=0.35.

Figure 7:
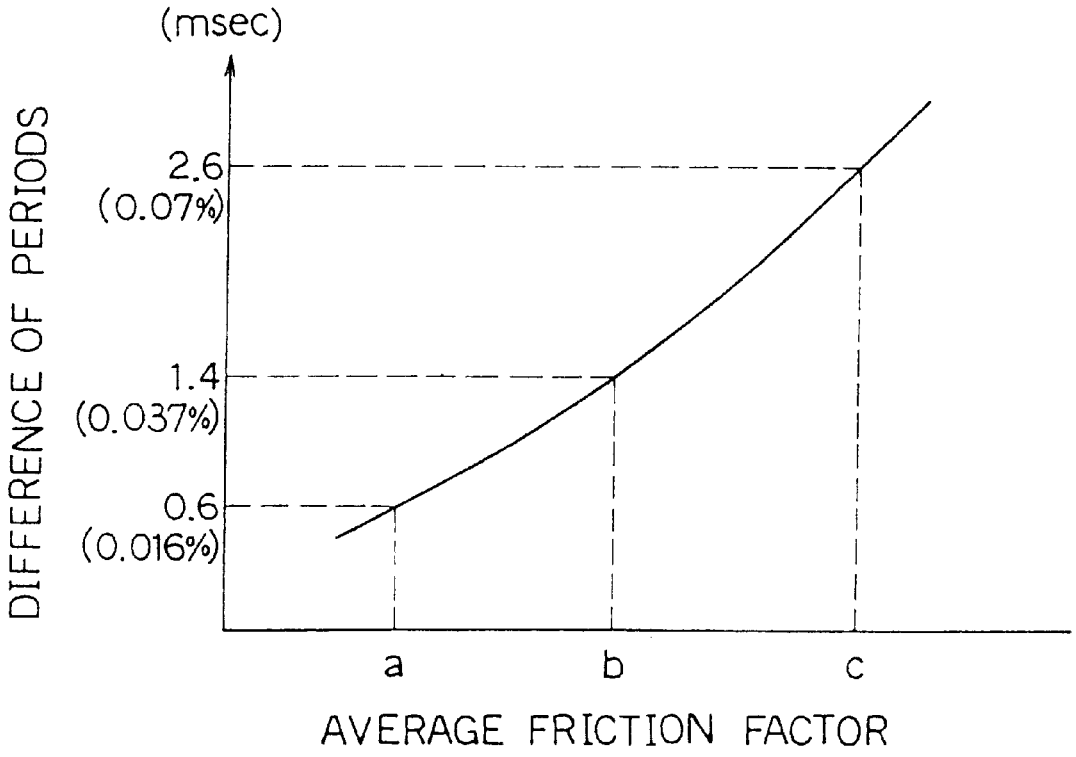
FIG. 7 is a graph showing an average friction factor and a rotation period difference between a drive shaft and an intermediate transfer belt when a cleaner blade is pressed against the drive shaft.

FIG. 7 is a graph in which abscissa represents the average friction factor p between the intermediate transfer belt 50 and the drive roller 55A, and the ordinate represents the difference of the rotation period of the intermediate transfer belt 50 between when the cleaner 51 pressed against the intermediate transfer roller 50 and when the cleaner 51 is separated from the intermediate transfer roller 50. "a" on abscissa of FIG. 7 represents the average friction factor of the drive roller 55A of this embodiment for which aluminum is used, and its value is 0.35 from the expression (1). "b" represents the friction factor of a drive roller 55A which is formed by coating an aluminum-made base material with urethane resin, heating it at 120 deg.C. for one hour and hardening it, and its value is 0.45. "c" represents the friction factor of a drive roller 55A which has its surface lined with rubber (EPDM), and its value is 0.6. The drive rollers 55A mentioned above have the same outside diameter, and the surface materials of the drive rollers 55A are uniform on the entire surfaces.

According to this graph, the greater the average friction factor is, the greater the rotation period due to the pressing by the cleaner 51 is. The increase in rotation period indicates that the speed of the intermediate transfer belt is reduced. The reduction in speed of the intermediate transfer belt 50 causes a shrinkage in the pitch of the image on the intermediate transfer belt 50. Therefore, the greater the average friction factor of the drive roller 55A is, the more likely a positional shift is caused by the pressing by the cleaner 51.

With respect to the result, inventors consideration as to action is described hereafter. First, the intermediate transfer belt 50 becomes thinner by being pressed by the cleaning blade 53, so that the frictional force between the intermediate transfer belt 50 and the drive roller 55A increases by the pressing at that portion. Since the intermediate transfer belt 50 becomes thinner, the average speed of the intermediate transfer belt 50 is lower at the pressed portion than when the intermediate transfer belt 50 is not pressed. Because of the frictional force at the pressed portion, a force in a direction opposite to the running direction of the intermediate transfer belt 50 runs acts on the intermediate transfer belt 50, so that the running speed of the intermediate transfer belt 50 decreases.

According to this embodiment, by setting the average friction factor between the intermediate transfer belt 50 and the drive roller 55A to not more than 0.45, preferably, not more than 0.4, the positional shift can be restrained to an extent that no problem is caused in practical use, and excellent images are obtained.

A "first toner image" is defined as a toner image which is formed in the state that the cleaning blade 53 is separated from the intermediate transfer belt 50. A "second toner image" is defined as a toner image which is formed in the state that the cleaning blade 53 is pressed to the intermediate transfer belt 50. A "first rotation period" is defined as a rotation period of the intermediate transfer belt 50 on which the first toner image is formed. A second rotation period is defined as a rotation period of the intermediate transfer belt 50 on which the second toner image is formed.

In the arrangement of this embodiment, the maximum positional shift due to variation of rotation period when the intermediate transfer belt 50 is rotated together with the photoconductor 30 is approximately 10 μm which is a level that causes no problem. When the friction factor between the drive roller 55A and the intermediate transfer belt 50 is not less than 0.1, the intermediate transfer belt 50 can be rotated with stability under a condition where the intermediate transfer belt 50 is supported about the driven rollers 55B, 55C and 55D and is in contact with the photoconductor 30. When a metal such as aluminum is used for the drive roller 55A, excellent images are obtained by setting the surface roughness of the drive roller 55A to not more than Ra 6.3 μm, preferably, not more than Ra 3.2 μm.

Since the frictional force between the drive roller 55A and the intermediate transfer belt 50 is set to a low value as mentioned above, in order for the intermediate transfer roller 50 to rotate with stability, it is necessary to restrain the rotation load of the intermediate transfer belt 50 including the driven rollers 55B, 55C and 55D. In this embodiment, the rotation load is set to 200 gf-cm on the drive roller 55A. With such a low rotation load, remarkable jitter is caused in the gear system for driving the intermediate transfer belt 50. In addition, a torque change occurs due to the friction between the intermediate transfer belt 30 and the photoconductor 30 and the deformation of the intermediate transfer belt 50, and the speed of the intermediate transfer belt 50 is varied due to a backlash of engaging gears, so that a positional shift is caused. In this embodiment, an appropriate load is imposed on the drive system by imposing a friction load on the drive roller 55A by pressing the friction pad 63 against the drive roller 55A. By stabilizing the gear engagement thereby, the generation of the jitter and the positional shift can be prevented.

Figure 8:
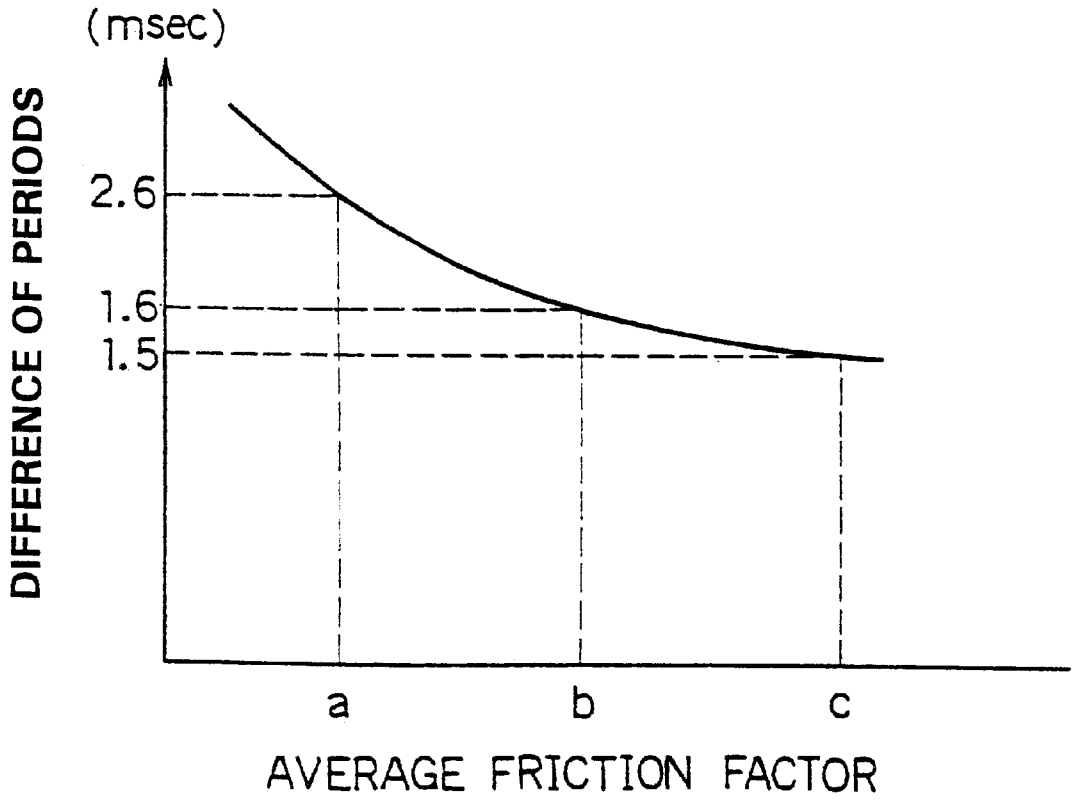
FIG. 8 is a graph showing the average friction factor and the rotation period difference between the drive shaft and the intermediate transfer belt when a load is imposed on a driven shaft.

FIG. 8 shows variation in rotation period of the intermediate transfer belt 50 when it is assumed that, for example, a load corresponding to the pressing by the cleaner 51 is imposed on the backup roller 55B serving as a driven roller in the arrangement of this embodiment. In FIG. 8, abscissa represents the average friction factor between the drive roller 55A and the intermediate transfer belt 50, and ordinate represents the increase in rotation period when the load is imposed, with respect to the rotation period when the load is not imposed. It is apparent from this graph that the greater the friction factor of the drive roller 55A is, the smaller the slip between the backup roller 5B and the intermediate transfer belt 50 is. a, b and c on the abscissa represent the average friction factors which are the same as those of FIG. 7.

Comparing the difference $d_1$ in rotation period when the average friction factor is c of the graph of FIG. 8 and the difference $d_2$ in rotation period when the average friction factor is a of the graph of FIG. 7, the difference $d_1$ is much smaller than the difference $d_2$. From this, it is found that variation in rotation period is smaller when the drive roller 55A is made of aluminum and the cleaner 51 is pressed against the drive roller 55A than when the drive roller 55A is lined with rubber and the cleaner 51 is pressed against the driven roller. Therefore, by setting the friction factor of the drive roller 55A to a low value and using the drive roller 55A as a backup member for the cleaner 51, the reproducibility of each color for the rotation of the intermediate transfer belt 50 during image formation is ensured, and excellent images are obtained in which there is no positional shift.

Particularly, when switching is performed among a plurality of photoconductors 30, variation in pitch of recorded images caused by variation in peripheral speed of the photoconductor 30 due to decentering is corrected by the slip between the intermediate transfer belt 50 and the photoconductor 30 which are running at constant speed. Therefore, it is particularly important to secure the reproducibility for each color under a condition where the intermediate transfer belt 50 is running.

In the above-described arrangement, the photoconductor 30 with an outside diameter of 30 mm (with a peripheral length of approximately 94.2 mm) is used, and the photoconductor 30, the intermediate transfer belt 50 and the recording paper 64 move at constant speed. Therefore, a predetermined image length on the intermediate transfer belt 50 is 287 mm, and the peripheral length corresponding to a rotation angle of 180 degrees from the exposure position to the transfer position on the periphery of the photoconductor 30 is 47.1 mm. Moreover, the movement amount of the intermediate transfer belt 50 from the activation of drive to the start of exposure at the start of image formation for each color is 30 mm, and the movement amount of the intermediate transfer belt 50 from the end of image formation for each color to the stop of the drive mechanism 31 is 12 mm.

The minimum necessary length of the intermediate transfer belt 50 for image formation is the sum of the above-mentioned lengths, i.e. 376.1 mm. On the contrary, the actual belt length is four times the peripheral length of the photoconductor 30, i.e. 377 mm, which satisfies the minimum necessary length. By minimizing the length of the intermediate transfer belt 50, the overall size of the apparatus and the rotation time of the intermediate transfer belt 50 can be reduced, so that the throughput of the image can be improved.

Figure 9:
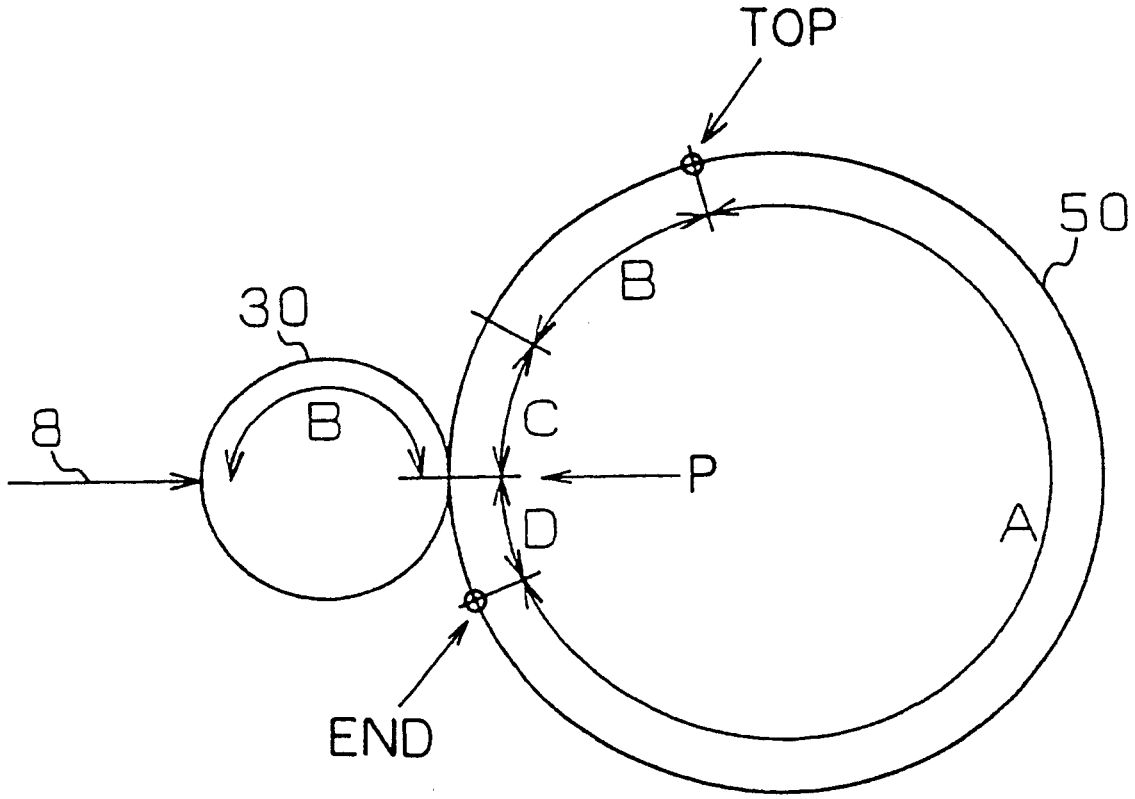
FIG. 9 is a schematic view showing lengths of a photoconductor and the intermediate transfer belt necessary for color image formation.

Here, it is provided that the predetermined image length on the intermediate transfer belt 50 is A (hereinafter, referred to as length A) and that the length on the intermediate transfer belt 50 from the position of exposure to the position of transfer to the intermediate transfer belt 50 on the periphery of the photoconductor 30 is B (hereinafter, referred to as length B). Moreover, it is provided that the movement amount of the intermediate transfer belt 50 during the time from the activation of the drive mechanism 31 being stopped to the start of exposure at the start of image formation for each color is C (hereinafter, referred to as length C). Further, it is provided that the running distance of the intermediate transfer belt 50 from the end of transfer of images onto the intermediate transfer belt 50 to the stop of the intermediate transfer belt 50 is D (hereinafter, referred to as length D). The length necessary for image formation is the sum A+B+C+D. FIG. 9 schematically shows these lengths. In FIG. 9, the intermediate transfer belt 50 is shown as a circle for convenience.

Figure 10:
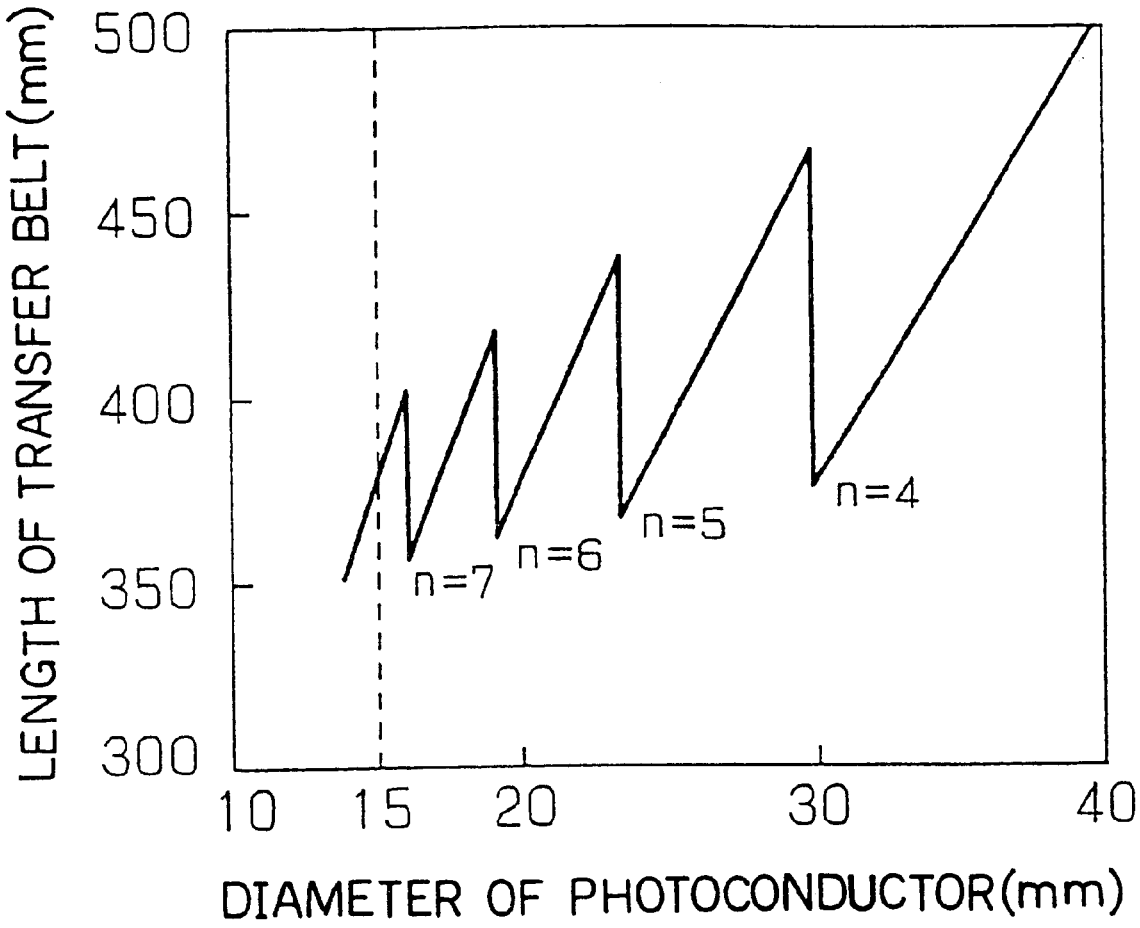
FIG. 10 is a graph showing a relationship between the diameter of the photoconductor and the peripheral length of the intermediate transfer belt applied to the color image forming apparatus in the first embodiment of the present invention.

When the speeds of the photoconductor 30 and the intermediate transfer belt 50 are constant, the belt length LT of the intermediate transfer belt 50 is decided based on the sum A+B+C+D of the necessary lengths and the peripheral length LP of the photoconductor 30. The condition is LT>A+B+C+D, and LT=n×LP (n is an integer). This relationship is shown in FIG. 10. Here, A=287 mm, and letting the angle θ of rotation from the exposure to the transfer on the photoconductor 30 be 180 degrees, B, C and D take the following values:

B=LP×(180/360) mm;

C=30 mm; and

D=12 mm.

It is apparent from FIG. 10 that the diameter d of the photoconductor 30 where the belt length LT is minimized exists as discrete values. The minimum values are obtained from the following expression (2).

$$d=(A+C+D) / \{(n-(\theta/360)\times\pi\} \quad \ldots (2)$$

Moreover when the peripheral speed ratio between the intermediate transfer belt 50 and the photoconductor 30 is 1:W, the diameter d is defined by the expression (2)'.

$$d=(A+C+D) / \{(n-(\theta/360)\times\pi/w\} \quad \ldots (2)'$$

Here, the ratio n between the peripheral length LP and the belt length LT is an integer, and the peripheral length LP is set to the lowest value that satisfies LT>A+B+C+D and LT=n×LP. In actuality, it is unnecessary to use a minimum value corresponding to the lowest value of n as the belt length, and practically, a value is appropriate which is higher than the minimum value by not more than 10%. That is, the range of the appropriate value is as shown by the expression (3).

$$1.1\times(A+B+C+D)/n \geqq LP \geqq (A+B+C+D)/n \quad \ldots (3)$$

The photoconductor diameter d and the belt length LT are decided within this range in consideration of the price, availability and variation in the lengths A, B, C, D and LT.

In this embodiment, the photoconductor diameter is 30 mm, and the peripheral length LP is 94.2 mm. A value (A+B+C+D)/4 is 94.0 mm, and the peripheral length LP is an approximate value not less than one-fourth of the sum A+B+C+D. The difference between the peripheral length LP and the minimum value is the tolerance for variation in the lengths on the intermediate transfer belt 50. Numerically expressing the peripheral length within 10% of the practical range, 94<LP5103 mm. Expressing as an outside diameter, the peripheral length is not less than 29.9 mm and not more than 32.9 mm.

Since the surface speeds of the intermediate transfer belt 50 and the photoconductor 30 are substantially the same, the ratio between the peripheral length LP of the photoconductor 30 and the belt length LT is 4:1, and the ratio between the numbers of rotations of the intermediate transfer belt 50 and the photoconductor 30 is 1:4. That is, the belt length is substantially minimum, and the ratio between the numbers of rotations of the intermediate transfer belt 50 and the photoconductor 30 is an integer. Therefore, the periodic speed variation due to decentering of gears constituting the drive system is synchronized with the rotation of the intermediate transfer belt 50. For this reason, the speed variation is the same for all the colors even though speed variation exists in the drive system and the relative speed difference among the colors is not caused, so that the generation of color displacements can be prevented.

It is apparent from FIG. 10 that a belt length of 377 mm and a photoconductor diameter of 24 mm or 30 mm are a substantially optimum combination when the speeds of the photoconductor 30 and the intermediate transfer belt 50 are constant. The photoconductor with diameter of 30 mm or 24 mm is widely available and inexpensive, so that the apparatus can be structured with a low cost.

Figure 11:
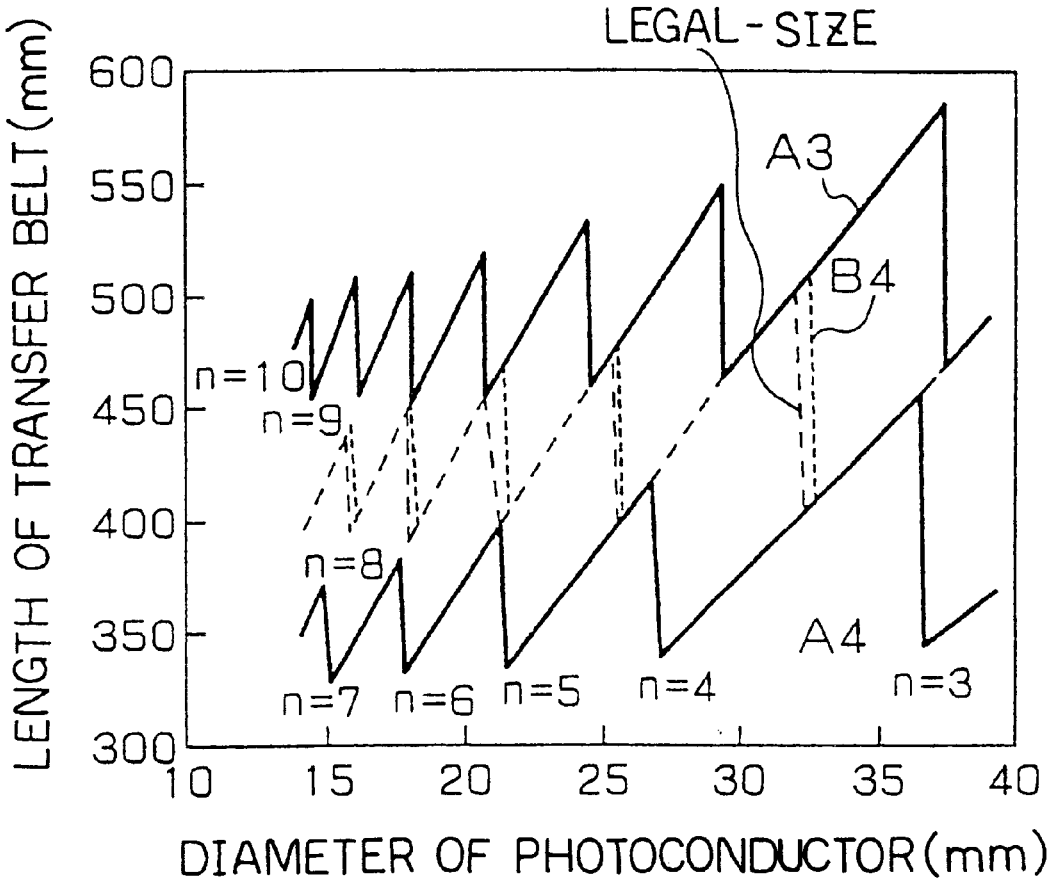
FIG. 11 is a graph showing a relationship between the diameter of the photoconductor and the peripheral length of the intermediate transfer belt applied to the color image forming apparatus in the first embodiment of the present invention.

Typically, standard image sizes are A4 (297 mm in long-side length) and A3 (420 mm in long-side length). On the intermediate transfer belt 50, it is necessary that the sum (C+D) in the non-image formation section be approximately 20 mm, and it is necessary that the angle of rotation of the photoconductor 30 from exposure to transfer be 90 degrees. FIG. 11 shows an optimum relationship among the photoconductor diameter d, the belt length LT and the peripheral length ratio n for each recording paper size.

Generally, when the photoconductor diameter d increases, the length of the peripheral length B of FIG. 9 where recording is impossible unnecessarily increases and the overall size of the apparatus incorporating a plurality of photoconductors increases. For this reason, it is preferable that the photoconductor diameter be not more than 40 mm. Particularly, when the apparatus is used as an image forming unit having a photoconductor, it is preferable that the photoconductor diameter be not more than 32 mm. Moreover, a photoconductor diameter which is too small is impractical. Practically, it is necessary that the photoconductor diameter be not less than 15 mm. It is preferable that the peripheral length of the intermediate transfer belt 50 be not less than 330 mm and not more than 400 mm.

From FIG. 11, even though the recording paper size is A4, if n is less than 3, the photoconductor diameter increases and exceeds 40 mm. Moreover, even though the recording paper size is A3, if n exceeds 9, the photoconductor diameter is less than 15 mm. Therefore, the appropriate value of n for each recording paper size is not less than 3 and not more than 7 for the length of A4, not less than 4 and not more than 8 for a length of 358 mm of the legal size, not less than 4 and not more than 8 for a length of 364 mm of B4, and not less than 4 and not more than 9 for the length of A3.

Since the intermediate transfer belt 50 is in contact with the photoconductor 30 in a range where the intermediate transfer belt 50 is supported about the support rollers, the contact pressure is restrained even if the photoconductor 30 rubs against the intermediate transfer belt 50 with no provision of a mechanism for separating the photoconductor 30 from the intermediate transfer belt 50. Therefore, there is no possibility that the photoconductor 30 and the intermediate transfer belt 50 are demanded by rubbing, and the image quality is degraded.

As described above, according to the first embodiment, the intermediate transfer belt is supported and rotated. The drive roller in which the average friction factor of the surface in contact with the intermediate transfer belt is not more than 0.45 and not less than 0.1 is used as a backup member. After toner image transfer onto the intermediate transfer belt 50 is started, the cleaning blade 53 is separated and comes into contact before transfer of the toner image of the last color is finished. Thereby, the difference in rotation speed of the intermediate transfer belt between when the cleaning blade 53 is pressed and when the cleaning blade 53 is separated can be restrained, so that excellent images can be obtained in which there is no positional shift.

Further, the cleaning blade 53 is separated and comes into contact during toner image formation onto the intermediate transfer belt 50. Thereby, toner image formation on the intermediate transfer belt and cleaning can be simultaneously performed, so that the peripheral length of the intermediate transfer belt can be set to be small. As a result, size reduction of the apparatus and improvement of the throughput can be realized.

Since the surface of the drive roller which comes into contact with the belt-form image carrier is formed by metal, a drive roller with high accuracy and excellent durability can be inexpensively structured in which the factor of friction with the intermediate transfer belt is not more than 0.45 and not less than 0.1.

Since the surface roughness of the surface of the drive roller which comes into contact with the belt-form image carrier is not more than Ra 6.3 $\mu$m, a drive roller with high accuracy can be inexpensively and stably structured in which the factor of friction with the intermediate transfer belt is not more than 0.45 and not less than 0.1.

By imposing the rotation load on the drive roller, an appropriate load can be imposed on the drive roller without increase of the rotation load of the belt-form image carrier. For this reason, the speed variation due to jitter of the drive roller can be restrained while the slip between the belt-form image carrier and the drive roller is restrained. Thereby, excellent images are obtained in which there is neither positional shift nor drive jitter.

By forming the toner image by transferring the toner image from the photoconductor which is rotating at constant angular speed to the intermediate transfer belt which is rotating at constant speed, images having no positional shift can be obtained even if the peripheral speed of the photoconductor varies due to decentering. Moreover, since the toner image which has already been formed on the intermediate transfer belt does not affect the toner image of the next color on the photoconductor, high-definition images can be obtained.

By positioning one of a plurality of photoconductors so as to be switched between at the image formation position and at other retracted positions, an image forming unit can be used in which the photoconductor and the developer unit are integrated with each color. Thereby, maintenance such as replenishment of toner, replacement of the photoconductor and disposal of the waste toner is facilitated and the reliability of the apparatus is improved.

By integrally forming the drive shaft, the driven shaft and the intermediate transfer belt into one piece which is detachable, maintenance such as replacement of the intermediate transfer belt and disposal of the waste toner is facilitated and the reliability of the apparatus increases.

Since the peripheral length LT of the intermediate transfer belt and the peripheral length LP of the photoconductor satisfy the expression (3), the diameter of the photoconductor and the peripheral length of the transfer member can be optimized with respect to a predetermined image length. As a result, the overall size of the apparatus can be reduced, and the throughput of the image can be improved by the reduction in rotation time of the transfer member. Moreover, by synchronizing the speed variation of the drive system with the rotation of the intermediate transfer belt, the generation of color positional shift each color displacements can be prevented.

Moreover, since a transfer member is the intermediate transfer belt supported by a plurality of support shafts, the limit to the thickness and length of the recording paper is small, so that a variety of recording paper can be used. Moreover, since the freedom degree of the running path of the intermediate transfer belt is great, the size of the apparatus can be reduced.

Moreover, by entraining the intermediate transfer belt about two support shafts in an area where the intermediate transfer belt is opposed to the image forming unit situated at the image formation position, the contact pressure between the intermediate transfer belt and the photoconductor can be restrained. As a result, damage due to friction between the photoconductor and the intermediate transfer belt can be prevented.

Of the length where the photoconductor and the intermediate transfer belt rub against each other, the length from the transfer position on the downstream side in the running direction of the intermediate transfer belt is shorter than the movement amount of the intermediate transfer belt during the time from the end of image formation of each color to the stop of the drive means. Thereby, the rear end of the image is not rubbed while the image forming unit is moving even if the intermediate transfer belt is stopped immediately after the end of image formation of one color. For this reason, a high tolerance can be secured for nonuniformity and disturbance while the length necessary for image formation is maintained without the peripheral length of the transfer member being unnecessarily increased, so that high-definition images can be obtained with stability.

Of the lengths of the rubbing, the length from the image formation position on the upstream side in the running direction of the intermediate transfer belt is longer than the length on the downstream side. Thereby, the entrance distance at the time of activation can be secured which is necessarily longer than at the time of deactivation. Thereby, the apparatus can be structured by use of an intermediate transfer belt with a shorter peripheral length for the same photoconductor diameter. As a result, size reduction of the apparatus and improvement of the throughput can be realized. Moreover, since a high tolerance can be secured for nonuniformity and disturbance while the length necessary for image formation is maintained without the peripheral length of the intermediate transfer belt being unnecessarily increased, high-definition images can be obtained with stability.

By forming for each color the image forming unit with which a photoconductor and a developer unit are integrated, the size of the apparatus can be reduced, maintenance such as replenishment of toner, replacement of the photoconductor and disposal of the waste toner can be facilitated, and the reliability of the apparatus can be improved.

In this embodiment, the peripheral speeds of the photoconductor 30 and the intermediate transfer belt 50 are constant. However, the gear ratio of the drive system may be changed so that there is a difference between the peripheral speeds thereof. For example, a case is considered in which the peripheral speed ratio between the intermediate transfer belt 50 and the photoconductor 30 is 1:0.967. In this case, the predetermined length on the periphery of the photoconductor 30 increases by 3.3% on the intermediate transfer belt 50. Therefore, even if a photoconductor with an outside diameter of 29 mm is used, the peripheral length of the photoconductor is 94.1 mm as the length on the intermediate transfer belt because of the above-mentioned peripheral speed ratio. This corresponds to an outside diameter of 30 mm when the peripheral speed ratio is 1:1. Therefore, even when the outside diameter of the photoconductor is 29 mm, an intermediate transfer belt with a peripheral length of 377 mm can be used.

By thus reducing the peripheral speed of the photoconductor 30 so that there is a difference in peripheral speed between the photoconductor 30 and the intermediate transfer belt 50, the apparatus can be structured by use of a shorter intermediate transfer belt for the same photoconductor diameter. Thereby, size reduction of the apparatus and improvement of the throughput can be realized. Moreover, a high tolerance can be secured for nonuniformity and disturbance while the length necessary for image formation is maintained without the belt length being unnecessarily increased, so that high-definition images can be obtained with stability.

With respect to the peripheral speed ratio, the peripheral length of the intermediate transfer belt and the photoconductor diameter, when the peripheral speed ratio between the intermediate transfer belt 50 and the photoconductor 30 is 1:w, the peripheral length LT of the intermediate transfer belt 50 is necessarily LT>A+B+C+D, and the peripheral length LP is necessarily a value obtained by dividing (A+B+C+D)×w by an integer n or more and greater by not more than 10%. Expressing mathematically, LT and LP are as follows:

$$LT > A+B+C+D$$

$$1.1\times(A+B+C+D)\times w/n \geqq LP \geqq (A+B+C+D)\times w/n \quad \ldots (4).$$

The smaller the peripheral speed ratio w is, the smaller the diameter of the photoconductor can be. However, in order that images are not disturbed during the primary transfer, it is preferable that the peripheral speed ratio w be not less than 0.9 and not more than 1.

The image forming unit 3 is detachable from the body of the apparatus 40. However, it may be structured so as not to be detachable but to be fixed to the body of the apparatus 40. The intermediate transfer belt 50 is detachable from together with the support shaft as an intermediate transfer belt unit 20. However, it may be structured so as not to be detachable but to be fixed to the body of the apparatus 40.

In this embodiment, the intermediate transfer belt capable of being freely disposed and suitable for size reduction and unitization is used as the transfer member. However, similar effects are obtained by using a cylindrical intermediate transfer drum that has a similar peripheral length to the above-described intermediate transfer belt. Moreover, this embodiment can be realized by a transfer drum method in which the recording paper is conveyed and toner images of the colors are transferred onto the recording paper so as to be superimposed on one another. In this case, it is preferable that the surface of the transfer drum have resiliency.

The length of the recording paper is the long-side length of the A4 size. However, when recording paper of other size is used, the peripheral length of the intermediate transfer belt 50 is decided based on the above-described expression (4). For example, in the case of the A3 size, appropriate photoconductor diameter and belt length are 32 mm and 502.6 mm, respectively. Moreover, in the case of the B4 size, appropriate photoconductor diameter and belt length are 29 mm and 455.5 mm, respectively.

The pressing force of the cleaning blade is set to 20 gf/cm. However, by setting the pressing force within a range of 10 to 30 gf/cm, the cleaning performance and the variation in running speed of the intermediate transfer belt 50 when it comes into contact and is separated fall within ranges where they are excellent.

In order to secure the frictional force between the drive roller 55A and the intermediate transfer belt 50, it is desired that the angle of entrainment of the intermediate transfer belt 50 about the drive roller 55A is the maximum angle of entrainment which is greater than the angles of entrainment of the intermediate transfer belt 50 about the rollers 55B, 55C and 55D. For example, it is preferable that the angle be set to not less than 90 degrees.

Further, the friction load of the drive shaft is 800 gf-cm. However, as long as the friction load is within a range of 500 to 2000 gf-cm, activation can be performed within 300 msec., and excellent images are obtained in which there is no jitter.

[Second Embodiment]

Figure 12:
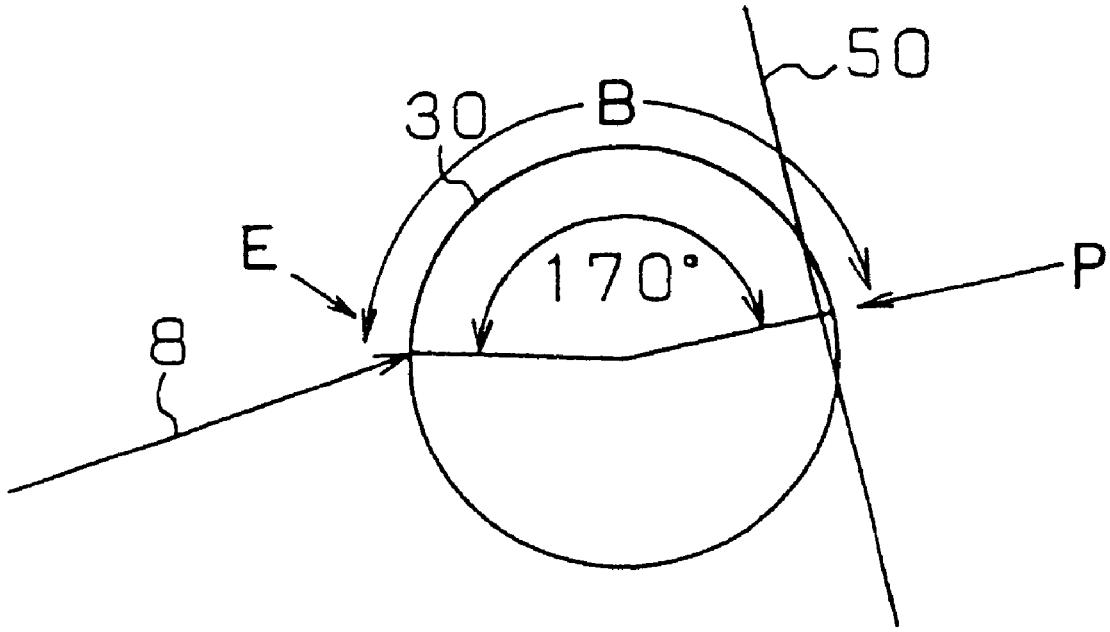
FIG. 12 is a schematic view showing a photoconductor of a color image forming apparatus according to a second embodiment of the present invention.

A color image forming apparatus according to a second embodiment of the present invention will be described with reference to FIG. 12. FIG. 12 is an enlarged side view showing a photoconductor of the color image forming apparatus according to the second embodiment of the present invention.

A characteristic of the second embodiment is that the central angle between an exposure position E to which the laser signal ray 8 is applied and the position 10 of transfer to the intermediate transfer belt 50 on the photoconductor 30 is 170 degrees. Other structures and operations will not be described in detail because they are the same as those of the first embodiment.

With the above-described arrangement, the peripheral length B from the exposure position E to the position 10 of transfer to the transfer member on the photoconductor 30 becomes 44.5 mm from 47.1 mm, and the length necessary for image formation is shorter by 2.6 mm. Therefore, according to this embodiment, for the same length of the intermediate transfer belt 50, the length necessary for image formation is maintained, and a high tolerance can be secured for nonuniformity and disturbance, so that high-definition images can be obtained with stability. Moreover, the apparatus can be structured by use of a shorter intermediate transfer belt 50 for the same photoconductor diameter, so that size reduction of the apparatus and improvement of the throughput can be realized.

[Third Embodiment]

Figure 13:
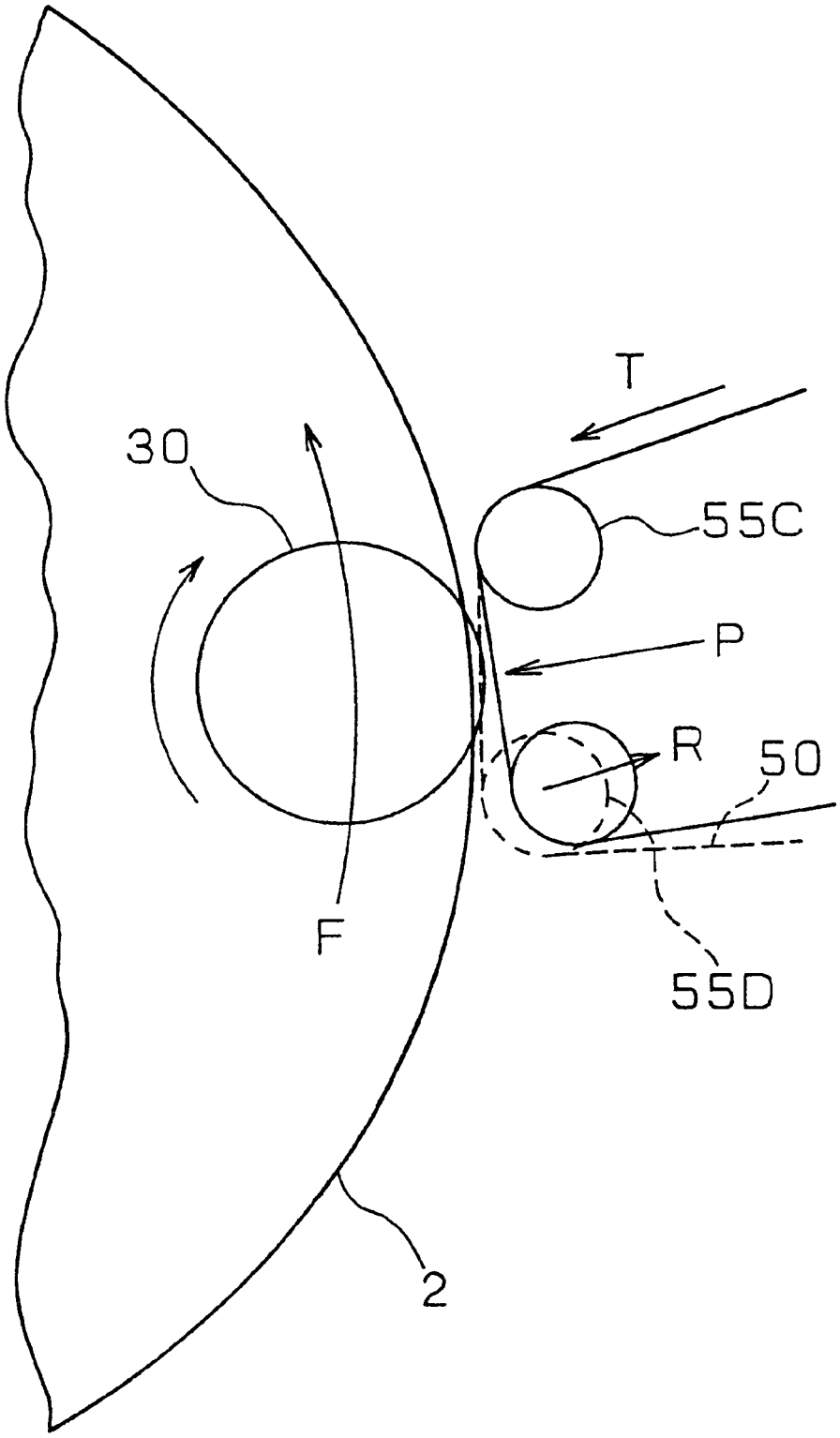
FIG. 13 is a layout sketch showing a primary transfer section of a color image forming apparatus according to a third embodiment of the present invention.

A color image forming apparatus according to the third embodiment of the present invention will be described with reference to FIG. 13. FIG. 13 is a side view showing a periphery of the portion where the photoconductor and the intermediate transfer belt abut each other in the color image forming apparatus according to the third embodiment of the present invention.

In the third embodiment, the tension roller 55D on the downstream side in the running direction of the intermediate transfer roller 55D is structured so as to be movable by 2 mm in the shown direction of the arrow R at the image formation position P. Thereby, the photoconductor 30 is held separated from the intermediate transfer belt 50 when the photoconductor 30 enters the image formation position P along the arrow F from the downstream side in the-running direction of the intermediate transfer belt 50 at the time of switching of the image forming unit 3. When the rotation of the carriage 2 is finished, the tension roller 55D is returned to its normal position by being moved in a direction opposite to the direction of the arrow R, so that the intermediate transfer belt 50 comes into contact with the photoconductor 30. Other structures and operations will not be described in detail because they are the same as those of the first embodiment.

In the first embodiment, as shown in FIG. 9, there is a distance corresponding to the length B+C from the transfer position P to an image front end Top on the upstream side in the running direction of the intermediate transfer belt 50. However, on the downstream side, there is only a distance corresponding to the length D to an image rear end End. For this reason, when a sufficient margin cannot be secured for the belt length, it is necessary to reduce the length D by reducing the distance from issuance point of a command to stop the intermediate transfer belt 50 and the photoconductor 30 to actual stop point. However, if the length D is reduced, the photoconductor 30 rubs against the rear end of the image on the intermediate transfer belt 50 at the time of switching of the image forming unit 3.

According to the third embodiment, the rubbing on the downstream side in the running direction of the intermediate transfer belt 50 can be prevented by holding the photoconductor 30 separated from the intermediate transfer belt 50. For this reason, the distance between the transfer position P and the image rear end End at the time of switching of the image forming unit 3 can be set to as short as 5 mm. Even though the distance is set to such a short one, the running distance D from the end of transfer to the intermediate transfer belt 50 to the stop of the intermediate transfer belt 50 can be reduced without the rear end of the image being disturbed by the photoconductor 30 at the time of switching. Since the running direction from the activation to the position detection of the intermediate transfer belt 50 can be set to a sufficiently long distance as a consequence, the running of the intermediate transfer belt 50 can be brought into a stable constant speed state at the time of the position detection of the intermediate transfer belt 50.

Thereby, for the same length of the intermediate transfer belt 50, the length necessary for image formation is maintained, and a high tolerance can be secured for nonuniformity and disturbance, so that high-definition images can be obtained with stability. Moreover, a comparatively short intermediate transfer belt can be used for the same photoconductor diameter, so that size reduction of the apparatus and improvement of the throughput can be realized.

As described above, in the third embodiment, the tension roller 55D is moved by 2 mm at the time of switching of the image forming unit 3, and the photoconductor 30 enters the image formation position P from the downstream side of the intermediate transfer belt 50 with the photoconductor 30 being separated from the intermediate transfer belt 50. However, it is unnecessary to completely separate the intermediate transfer belt 50 from the photoconductor 30 when the photoconductor 30 enters the image formation position. For example, by reducing the movement amount of the tension roller 55D to 1 mm so that the photoconductor 30 and the intermediate transfer belt 50 come into contact with each other immediately before the photoconductor 30 reaches the image formation position, the rubbing distance on the downstream side is reduced and similar effects are obtained.

[Fourth Embodiment]

Figure 14:
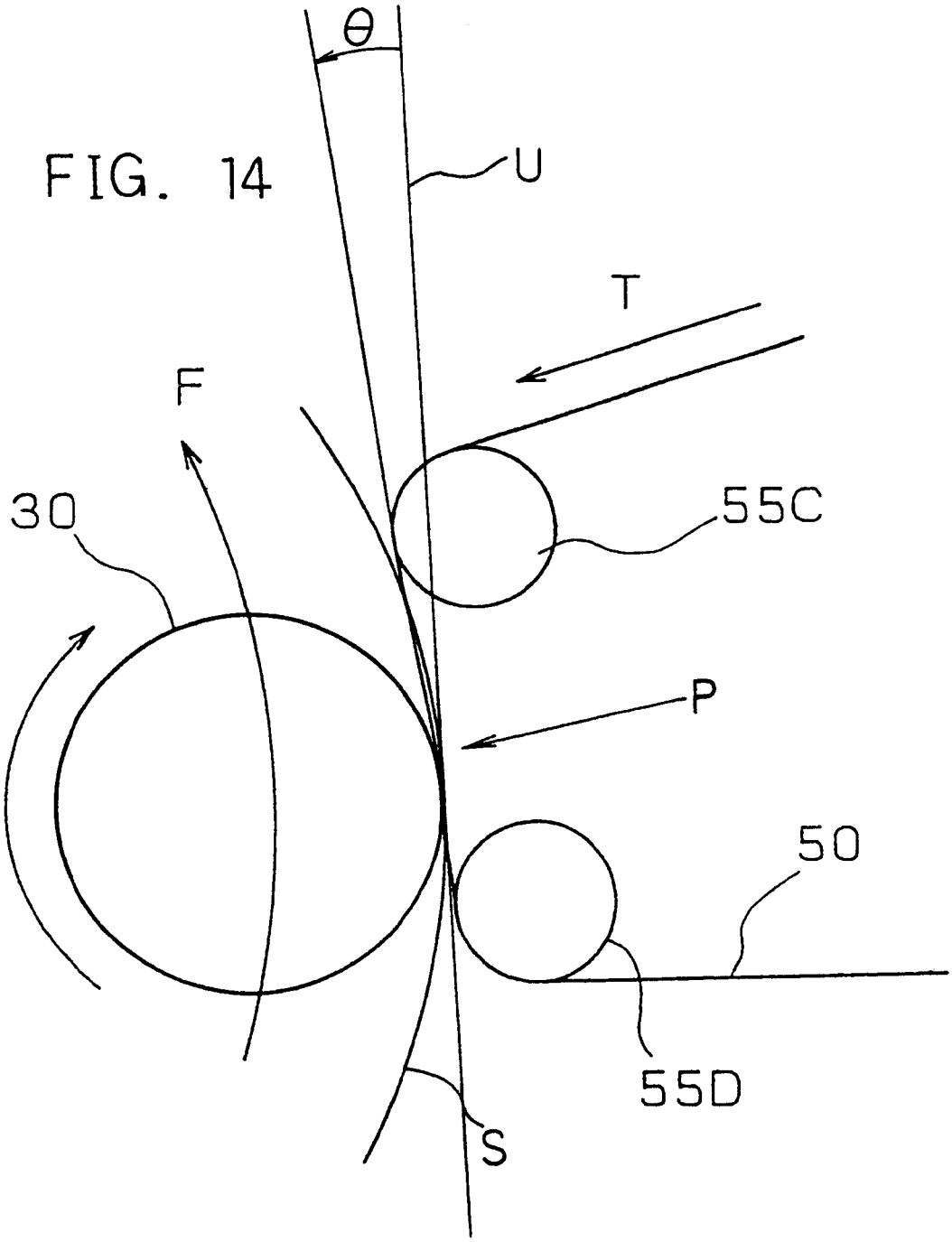
FIG. 14 is a layout sketch showing a primary transfer section of a color image forming apparatus according to a fourth embodiment of the present invention.

A color image forming apparatus according to the fourth embodiment of the present invention will be described with reference to FIG. 14. FIG. 14 is an enlarged side view showing a periphery of the portion where the photoconductor and the intermediate transfer belt abut each other in the color image forming apparatus according to the fourth embodiment of the present invention.

The fourth embodiment is different from the first embodiment in the following: The direction prolong to the surface of the intermediate transfer belt 50 which is opposed to the photoconductor 30 at the image formation position P is inclined 5 to 10 degrees from the tangential line U of the envelope S of the periphery of the moving photoconductor 30 toward the center of rotation of the carriage 2 on the upstream side in the running direction of the intermediate transfer belt 50. Other structures and operations will not be described in detail because they are the same as those of the first embodiment.

With the above-described arrangement, the rubbing distance between the photoconductor 30 and the intermediate transfer belt 50 in the switching operation of the image forming unit 3 is, with respect to the image formation position P, 5 mm on the downstream side in the running direction of the intermediate transfer belt 50 and 15 mm on the upstream side. Therefore, the rubbing distance between the intermediate transfer belt 50 and the photoconductor 30 increases on the upstream side of the intermediate transfer belt 50 and decreases on the downstream side without moving the support shaft of the intermediate transfer belt 50.

Consequently, the distance from the end of transfer to the intermediate transfer belt 50 to the stop of the intermediate transfer belt 50 can be reduced by a simple structure without disturbance of the rear end of the image. At the same time, since the running distance from the activation to the position detection of the intermediate transfer belt 50 can be set to a sufficiently long distance, the running of the intermediate transfer belt 50 can be brought into a stable constant speed state at the time of the position detection. Consequently, for the same length of the intermediate transfer belt, the length necessary for image formation is maintained, and a high tolerance can be secured for nonuniformity and disturbance, so that high-definition images can be obtained with stability. Moreover, for the same photoconductor diameter, the length of the intermediate transfer belt can be reduced, so that size reduction of the apparatus and improvement of the throughput can be realized.

[Fifth Embodiment]

Figure 15:
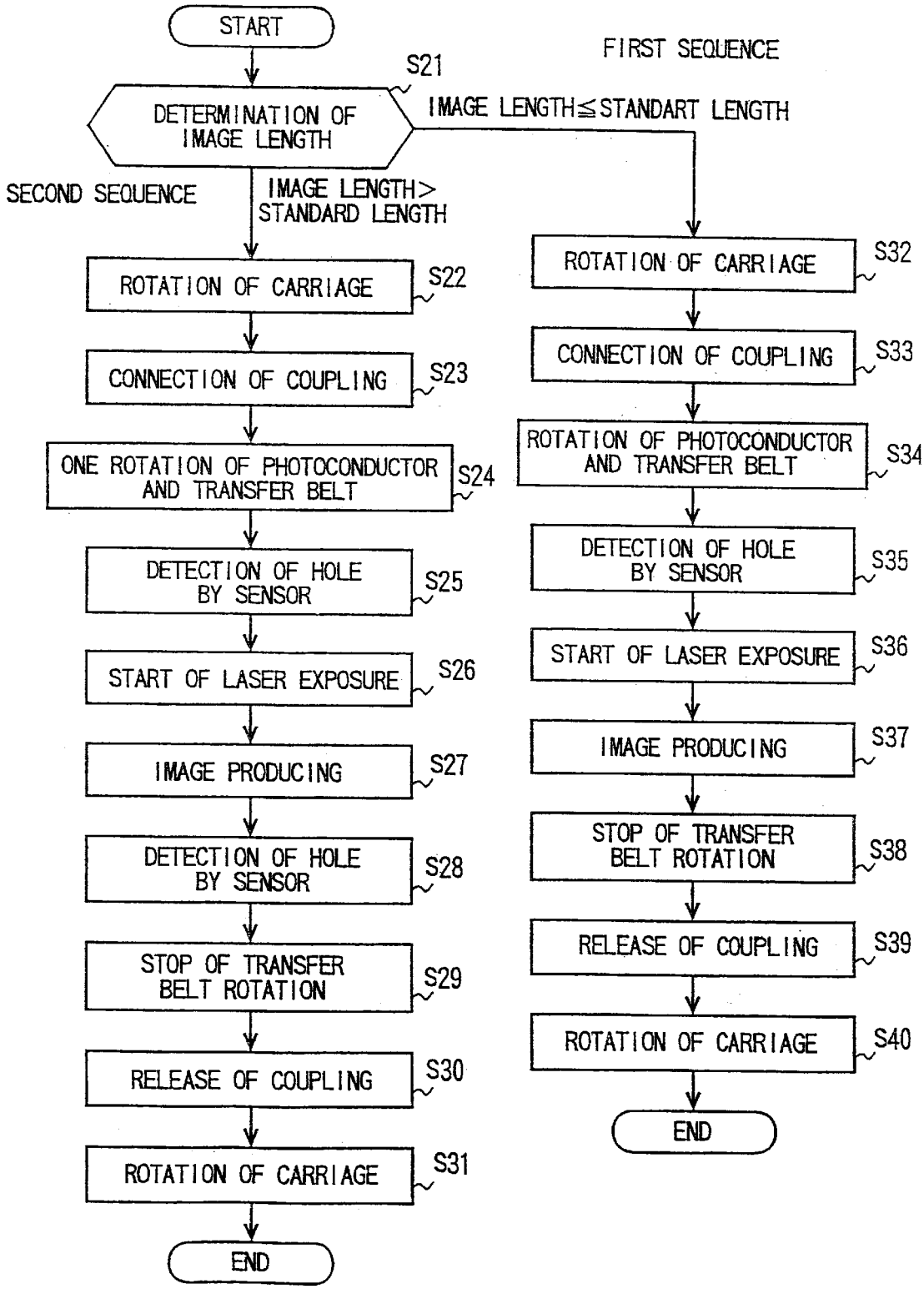
FIG. 15 is a flowchart showing an image forming sequence of a color image forming apparatus according to a fifth embodiment of the present invention.

A color image forming apparatus according to the fifth embodiment of the present invention will be described with reference to FIG. 15. FIG. 15 is a flowchart showing an image forming operation sequence of the color image forming apparatus according to the fifth embodiment of the present invention.

The fifth embodiment comprises, in addition to the elements of the first embodiment, a determination section for determining the length of the image to be formed, and a sequence switching section for switching the image forming operation sequence. Other structures and operations will not be described in detail because they are the same as those of the first embodiment.

The determination section determines the image length, on the intermediate transfer belt 50 corresponding to an input image signals (step S21 of FIG. 15). When the image length is equal to or below the standard length of 287 mm (A4), image formation operation is performed by a first sequence similar to the sequence of the first embodiment (steps S32 to S40). When it is determined that the image length is a second length, the sequence switching section switches the image forming sequence to the second sequence. The second length is longer than the first image length A4 (287 mm), and shorter than the distance obtained by subtracting the rubbing distance between the photoconductor 30 and the intermediate transfer belt 50 at the time of switching of the image forming unit 3 from the belt length of the intermediate transfer belt 50.

Concrete examples of the second image length will be shown below. When the image length is the standard length of 287 mm (A4), image formation is performed by the first sequence similar to the sequence of the first embodiment (steps S32 to S40).

The image length is, for example, 348 mm which is longer than 287 mm and not more than 359 mm obtained by subtracting from the belt length of 377 mm the rubbing distance of 28 mm between the photoconductor 30 and the intermediate transfer belt 50 at photoconductor switching. At this time, the sequence switching section switches the image forming sequence to the second sequence (steps S22 to S31).

In the second sequence, since the image length is as long as 348 mm, the detection hole 59*a* of the intermediate transfer belt 50 passes the position detection sensor 59 during image formation of one color. For this reason, during the first rotation of the intermediate transfer belt, it is impossible to transfer the images so as to be superimposed on the intermediate transfer belt 50 by applying the laser signal ray 8 in accordance with the timing of the front end of the image on the intermediate transfer belt 50.

Therefore, after the activation from the stop state (step S22), the drive mechanism 131 drives the photoconductor 30 and the intermediate transfer belt 50, and rotates the intermediate transfer belt 50 once at constant speed (steps S23 to S24). Exposure is started after a predetermined period of time has elapsed since the generation of the position detection signal of the second rotation of the intermediate transfer belt 50 (steps S25 to S26). After transfer of the image with a length of 348 mm is finished, the intermediate transfer belt 50 is stopped (steps S27 to S29). As described above, in the second sequence, images of the colors are formed by rotating the intermediate transfer belt 50 twice.

Since image formation is performed during the second rotation of the intermediate transfer belt which is running at constant speed, it is unnecessary to consider the speed variation at the time of activation of the drive mechanism 131. As a result, a full color image with a length of 348 mm can be formed on the intermediate transfer belt 50.

According to this embodiment, by providing the determination section and the sequence switching section, a full color image with a length of 348 mm obtained by subtracting the lengths of 5 mm of the top and bottom margins from the length (358 mm) of the legal size which is greater than the standard image length A4 can be formed on the legal-size paper. Legal-size full color images which are longer than A4 size full color images can also be formed. Moreover, the length necessary for image formation for the intermediate transfer belt 50 of the same length is maintained, and a high tolerance can be secured for nonuniformity and disturbance, so that high-definition images can be obtained with stability.

In this embodiment, the standard length which is the first image length is 287 mm, and the second image length is 348 mm. However, the lengths are not limited thereto. It is provided that the rubbing length between the photoconductor and the intermediate transfer belt in the switching operation of the image forming unit is E, that the belt length of the intermediate transfer belt is LT, and that the standard image length is A. When the determination section determines that the length of the image to be formed is longer than A and shorter than a difference LT-E on the intermediate transfer belt, by rotating the intermediate transfer belt twice in image formation of each color, various lengths of images can be handled.

Similar effects are obtained by setting the rubbing length E to be the same as the length of the transfer nip where the photoconductor 30 and the photoconductor transfer belt 50 come into contact with each other at the stop time before and after the switching of the image forming unit in order that the photoconductor 30 does not rub against the intermediate transfer belt 50 at the time of switching of the unit.

[Sixth Embodiment]

Figure 16:
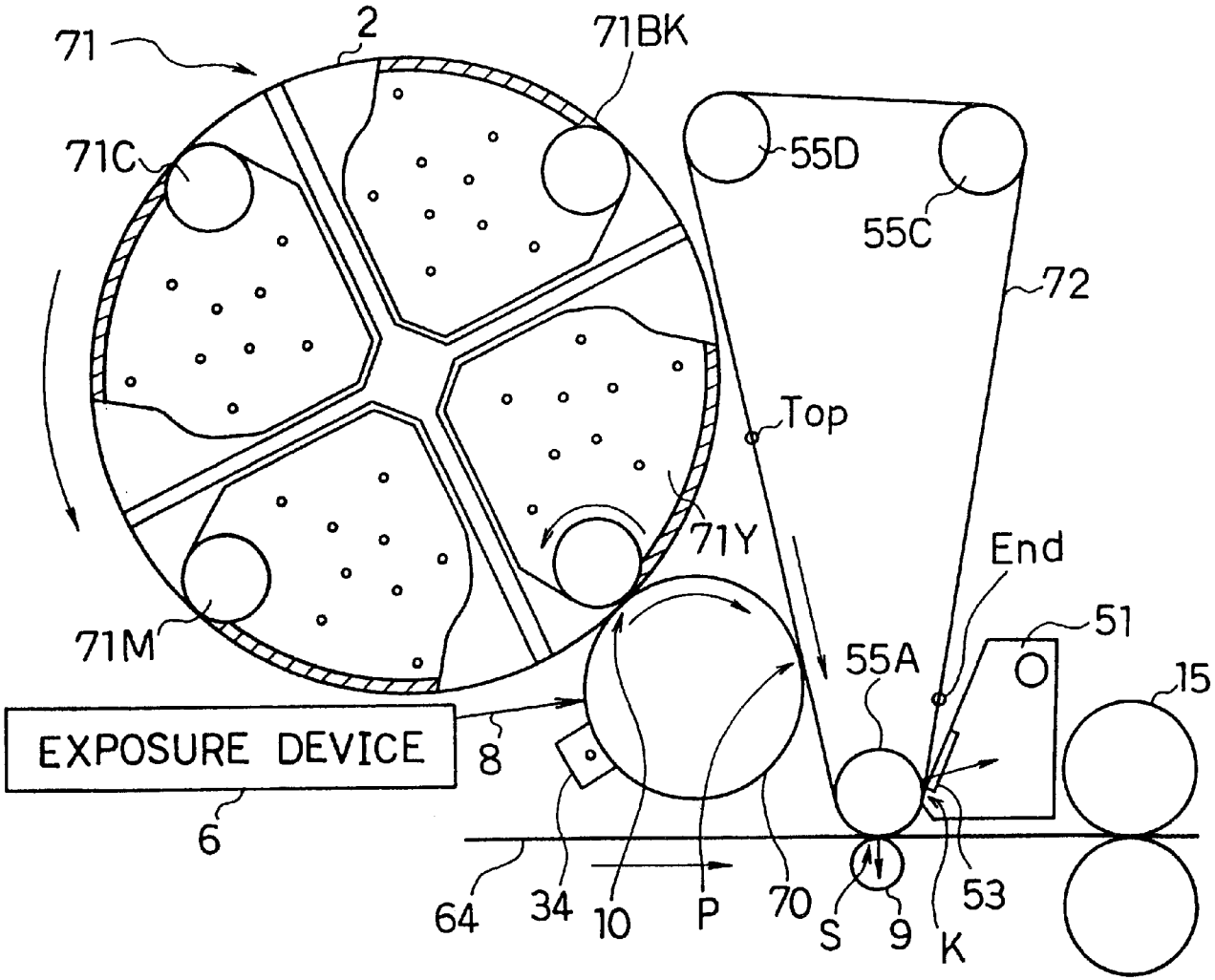
FIG. 16 is a side view showing relevant parts of a color image forming apparatus according to a sixth embodiment of the present invention.
Figure 17:
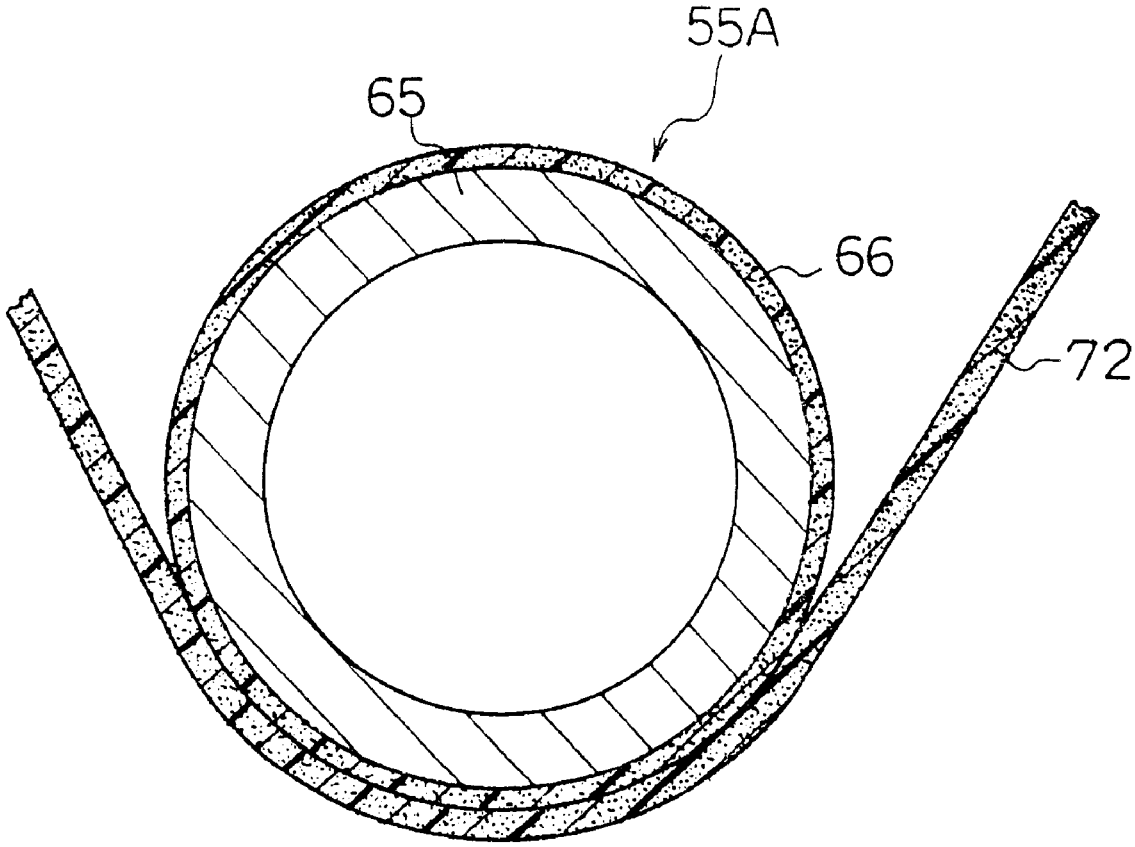
FIG. 17 is a cross-sectional view showing the structure of a drive roller in the sixth embodiment of the present invention.

A color image forming apparatus according to the sixth embodiment of the present invention will be described with reference to FIG. 16 and FIG. 17. FIG. 16 is a side view showing relevant parts of the color image forming apparatus according to the sixth embodiment of the present invention. FIG. 17 is a cross-sectional view showing the drive roller 55A.

In FIG. 16, a photoconductor 70 has an outside diameter of 45 mm. A developer unit 71 is provided for each of yellow, magenta, cyan and black. An intermediate transfer belt 72 has a peripheral length of 565 mm which is greater than the long-side length (420 mm) of A3-size recording paper. Unlike the arrangement of FIG. 1, only one photoconductor 70 is provided in the sixth embodiment. Color images are obtained by superimposing toner images of different colors on the intermediate transfer belt 72 by switching only the developer unit 71. Moreover, the drive roller 55A also serves as a backup member for the secondary transfer roller 9. The rollers 55A, 55C and 55D all have an outside diameter of 30 mm, and are supported by non-illustrated side plates of the body of the apparatus.

The distance from the primary transfer position P to the cleaning position K on the intermediate transfer belt 72 is shorter than the length of the non-image formation section which is the remainder of the subtraction of the image length from the peripheral length of the intermediate transfer belt 72. The drive roller 55A comprises, as shown in FIG. 17, an aluminum-made base material 65 covered with a coat layer 66 made of a low-friction material, for example, a material excellent in abrasion resistance such as Teflon resin, silicon resin or molybdenum solid coat. Moreover, the peripheral speeds of the photoconductor 70 and the intermediate transfer belt 72 are set so as to be substantially identical at the primary transfer section P.

Other elements that are similar to those of the first embodiment are designated the same reference numerals as those of FIG. 1. Hereinafter, the operation of the sixth embodiment will be described with reference to FIG. 16.

First, the image forming process is started by use of a yellow developer unit 71Y situated at the image formation position 10 which is opposed to the photoconductor 70. The developer unit 71Y, the charger 34 and the intermediate transfer belt 72 start to operate simultaneously with the start of rotation of the photoconductor 70. The intermediate transfer belt 72 rotates in the direction of the arrow by a frictional force by being driven by the drive roller 55A. At this time, the secondary transfer roller 9 and the cleaner 51 are separated from the intermediate transfer belt 72.

An electrostatic latent image is formed on the photoconductor 70 so as to be aligned with the image writing start position on the intermediate transfer belt 72. A yellow toner image is formed by developing the electrostatic latent image by the developer unit 71Y. The toner image is primary-transferred to the intermediate transfer belt 72. The yellow image formation is continued until the rear end of the image of the A3 size length is transferred to the intermediate transfer belt 72. When the transfer is finished, the photoconductor 70 and the intermediate transfer belt 72 are stopped at their initial positions. At this time, the image front end position (Top) has passed the cleaning position K and is situated upstream from the primary transfer position P, and the image rear end position (End) has passed the secondary transfer position S and the cleaning position K.

When the yellow image formation is finished, the carriage 2 rotates 90 degrees in the direction of the arrow, so that the yellow developer unit 71Y is moved from the image formation position and a magenta developer unit 71M is placed in the image formation position 10. When the carriage 2 stops, the photoconductor 70 and the intermediate transfer belt 72 start to operate, and image formation is performed in a manner similar to the yellow image formation. Consequently, yellow and magenta toner images are formed so as to be aligned and superimposed on the intermediate transfer belt 72.

The above-described operation is repeated for cyan, so that toner images of the three colors are formed so as to be superimposed on the intermediate transfer belt 72. After the primary transfer of the cyan toner image, the intermediate transfer belt 72 is stopped after the rear end of the toner image comprising the superimposed toner images of the three colors passes the secondary transfer position S and the cleaning position K. The secondary transfer roller 9 and the cleaner 51 are moved and pressed against the intermediate transfer belt 72 which is stopped.

Then, formation of the toner image of the last color, black, is performed, and the toner image comprising the superimposed toner images of the four colors is transferred onto the recording paper 64 so that the front end of the toner image is situated at a predetermined position.

When only one sheet of image is formed, after the secondary transfer is finished, the intermediate transfer belt 72 and the photoconductor 70 are stopped, and the secondary transfer roller 9 and the cleaner 51 are separated from the intermediate transfer belt. Lastly, the yellow developer unit 71Y is returned to the image formation position 10, and the color image formation is completed.

When images are continuously formed, with the cleaner 51 and the secondary transfer roller 9 being pressed against the intermediate transfer belt 72, image formation of the first color of the next image is performed by the black image forming unit 71BK situated at the image formation position 10. Then, the image is primary-transferred onto the intermediate transfer belt 72. The cleaner 51 and the second transfer roller 9 are separated from the intermediate transfer belt 72 before the primary transfer of the toner image of the first color, black, is started. After the black toner image is formed, the yellow developer unit 71Y is placed in the image formation position, and image formation is performed in a similar manner. By thus superimposing magenta and cyan toner images onto the intermediate transfer belt 72, a color image is formed.

The materials and workings of other elements are similar to those of the first embodiment.

In this embodiment, the peripheral length of the intermediate transfer belt 72 is longer than that of the first embodiment in order that images of the long-side length of the A3-size recording paper can be recorded. For this reason, the difference in rotation period of the intermediate transfer belt 72 between when the cleaning blade 53 is pressed against the intermediate transfer belt 72 with the drive roller 55A as a backup member and when the cleaning blade 53 is not pressed thereagainst must be smaller than that of the arrangement shown in the first embodiment. Moreover, since the running distance of the intermediate transfer belt 72 is long from when the cleaner 51 is pressed against the intermediate transfer belt 72 to when the primary transfer is finished, a great positional shift is caused even if the variation is small. In this embodiment, since the coat layer 66 made of a low-friction material is provided on the periphery of the drive roller 55A, the friction factor between the drive roller 55A and the intermediate transfer belt 72 is low. When the friction factor was not more than 0.4, preferably, not more than 0.35, excellent images were obtained in which the positional shift did not become a problem.

In this embodiment, the distance from the primary transfer position P to the cleaning position K is shorter than the length of the non-image formation section on the intermediate transfer belt 72. Moreover, since the cleaner 51 is pressed against the intermediate transfer belt 72 before the primary transfer of the last color is started, the peripheral length of the intermediate transfer belt 72 can be minimized. Thereby, the size of the apparatus can be reduced and the throughput can be improved.

After the primary transfer of the toner image of the third color, the secondary transfer roller 9 and the cleaner 51 are pressed against the intermediate transfer belt 72 while the intermediate transfer belt 72 is stopped. Further, when images are continuously formed, the secondary transfer roller 9 and the cleaner 51 are separated from the intermediate transfer belt 72 before the primary transfer of the image of the first color is started. By the above-described two operations, variation in impactive load imposed on running intermediate transfer belt 72 can be prevented. For this reason, the running of the intermediate transfer belt 72 is stabilized and the reproducibility of the operation improves, so that the positional shift and banding can be prevented.

As described above, according to the sixth embodiment, a low-friction material is applied onto the drive roller 55A also serving as a backup member for the cleaner 51. Thereby, size reduction of the apparatus and improvement of the throughput can be realized even if the running direction of the intermediate transfer belt 72 is long under a condition where the cleaner 51 is pressed, so that images can be obtained in which there is no positional shift.

Further, the distance from the primary transfer position P to the cleaner 51 is shorter than the length of the non-image formation section on the intermediate transfer belt 72. Thereby, banding can be prevented which is caused by speed variation due to variation in impactive load on the running of the intermediate transfer belt 72, and size reduction of the apparatus and improvement of the throughput can be realized.

In the sixth embodiment, the coat layer 66 is formed by applying a low-friction material onto the drive roller 55A. However, an arrangement may be employed such that a metal such as aluminum is used as the material for the drive roller 55A and the low-friction material is applied onto the inner surface of the intermediate transfer belt 72. In this arrangement, since the friction factor between the intermediate transfer belt 72 and the drive roller 55A can be set to be low, the reproducibility of the running of the intermediate transfer belt is secured and excellent images in which there is no positional shift can be obtained in the arrangement where the cleaner 51 is pressed with the drive roller 55A as a backup member.

Further, an arrangement may be employed such that a metal such as aluminum is used as the material for the drive roller 55A, a resin belt such as a polycarbonate belt or a rubber belt is used as the intermediate transfer belt 72 and powder of a low-friction material is attached to the contact surfaces of the drive roller 55A and the intermediate transfer belt 72. The effect of reducing the average friction factor of the contact surface of the drive roller 55A can be obtained also even with fine powder of alumina, stainless steel or silica, or fine powder of resin such as polycarbonate or POM whose friction factor as the material is not always low in solid state.

Moreover, in this embodiment, a low-friction material is applied to the entire area in the direction of the length of the contact surfaces of the drive roller 55A and the intermediate transfer belt 72, or powder is provided therebetween. However, in the arrangement where the low-frictional material or powder is applied or provided on a part of the contact surfaces, similar effects are obtained by setting the average friction factor of the entire contact surfaces to be within the above-mentioned range.

Moreover, polycarbonate is used as the material for the intermediate transfer belt 72. However, when a belt of resin such as PET or Teflon or a belt of rubber such as urethane is used, similar effects are obtained by setting the friction factor of the contact surface of the drive roller 55A within the above-mentioned range.

[Seventh Embodiment]

Figure 18:
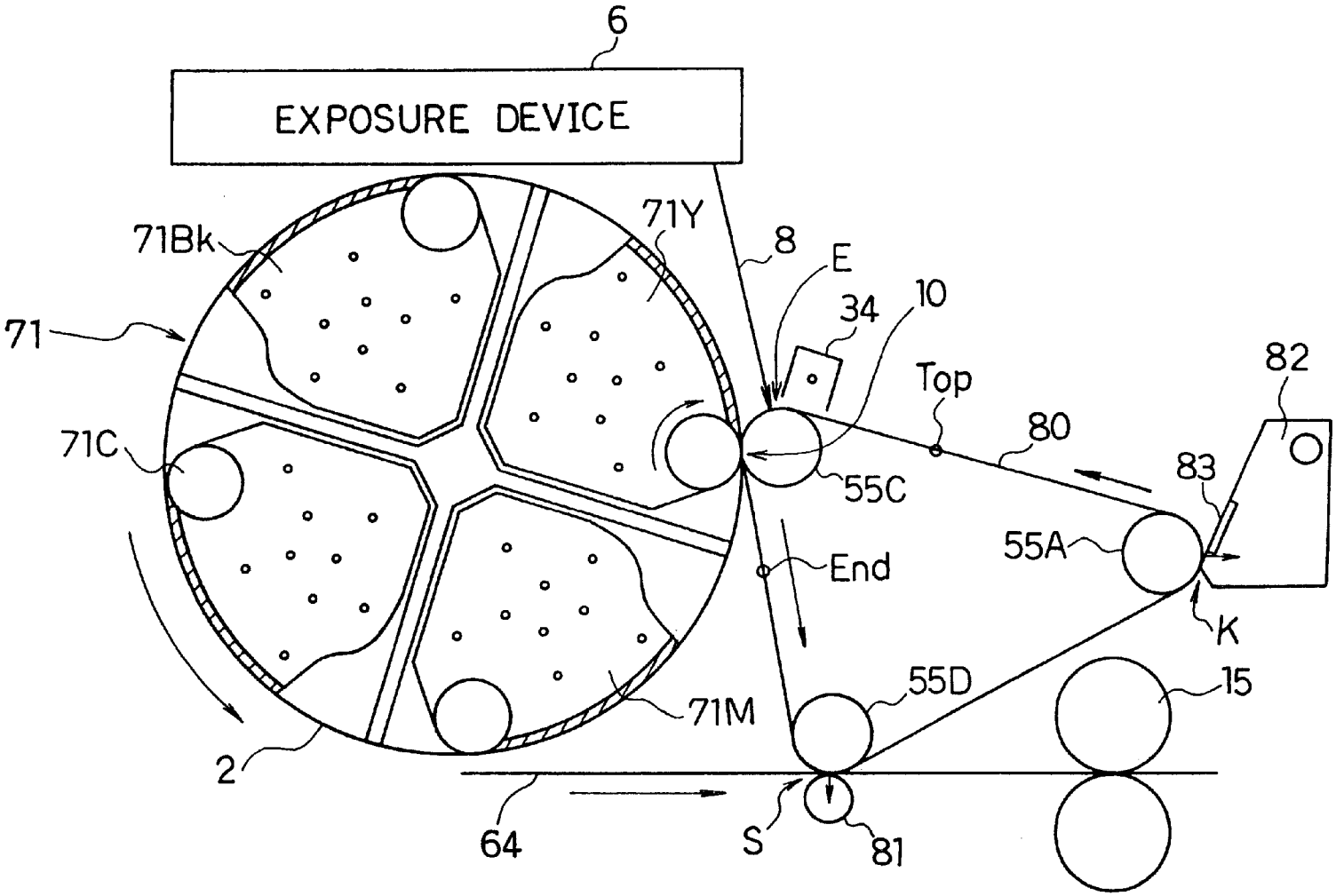
FIG. 18 is a side view showing relevant parts of a color image forming apparatus according to a seventh embodiment of the present invention.
Figure 19:
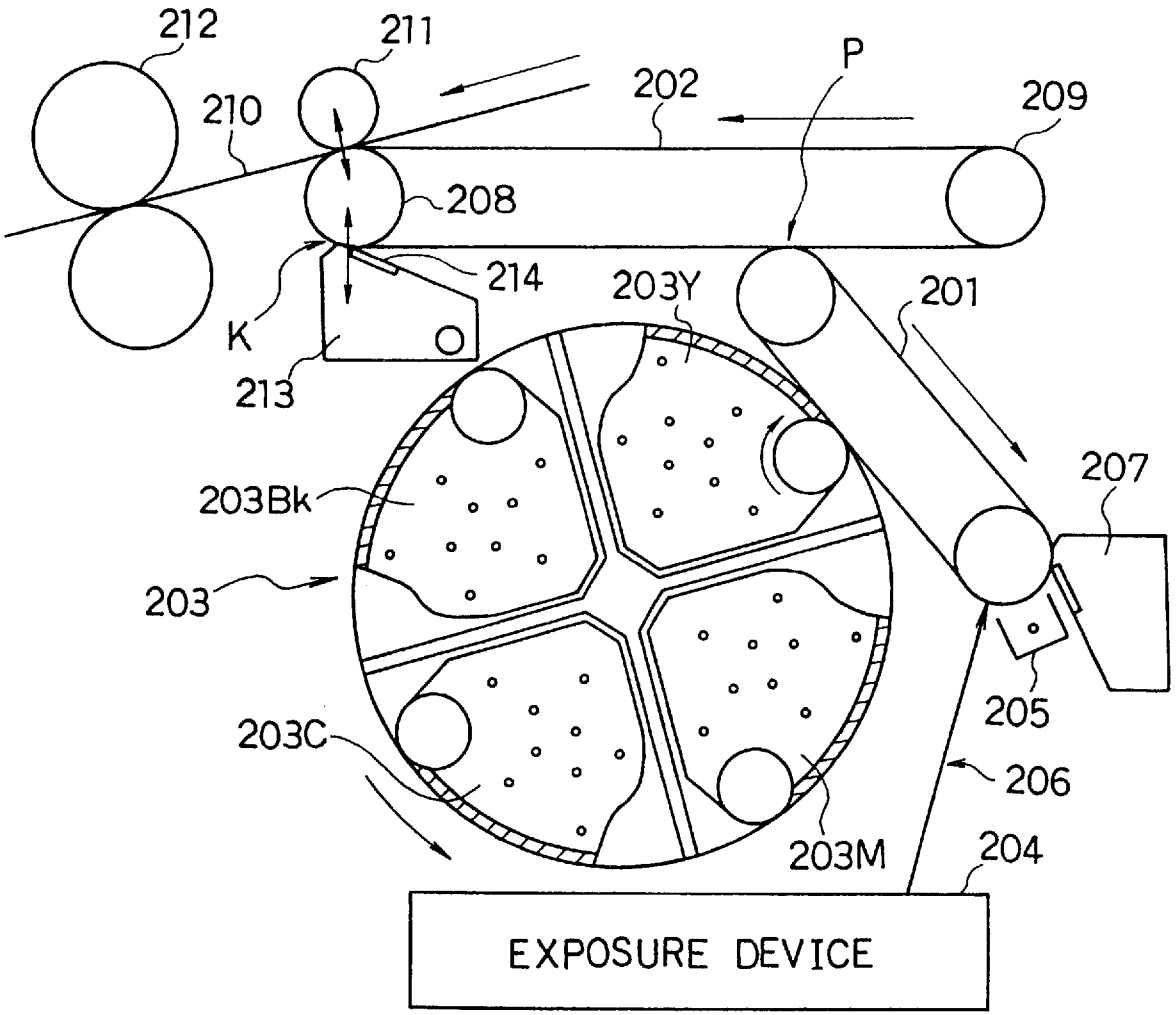
FIG. 19 (PRIOR ART)
FIG. 19 is the side view showing relevant parts of the color image forming apparatus of the first prior art.
Figure 20:
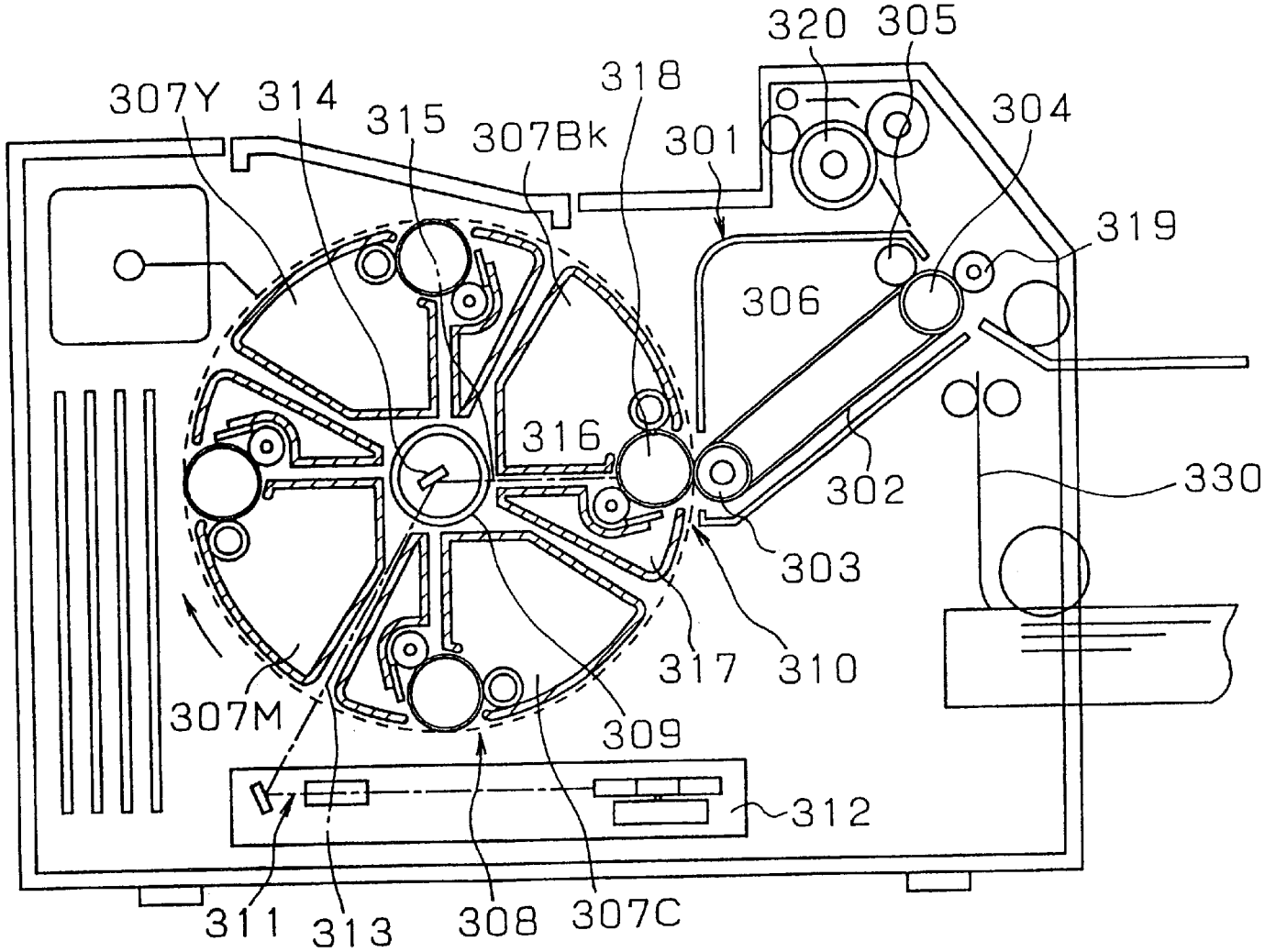
FIG. 20 (PRIOR ART)
FIG. 20 is the side view showing the color image forming apparatus of the second prior art.
Figure 21:
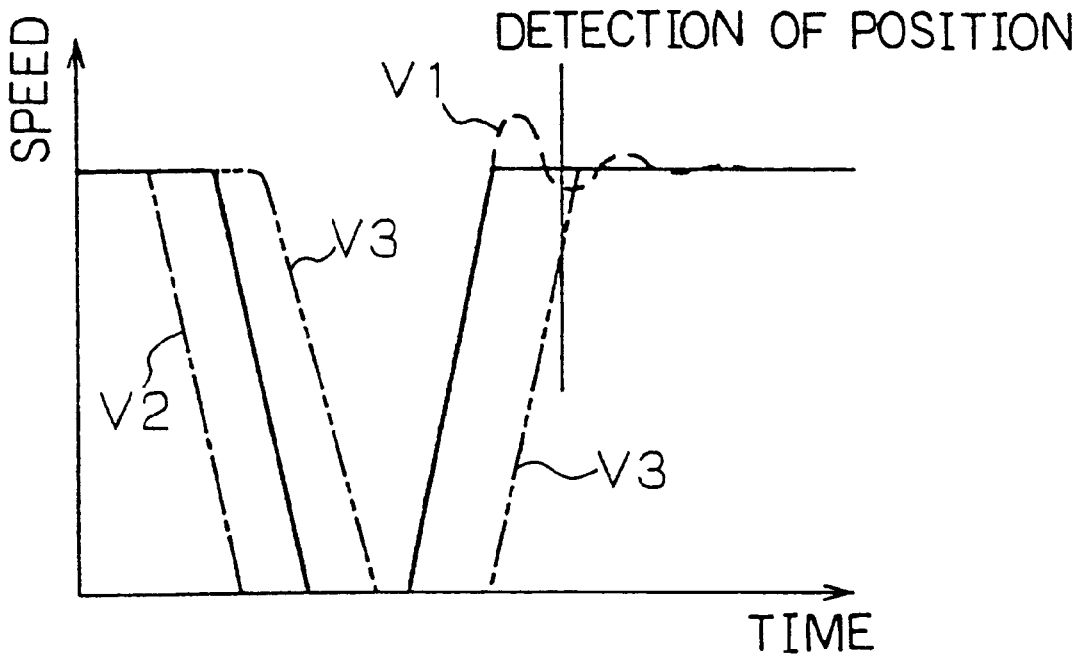
FIG. 21 (PRIOR ART)
FIG. 21 is the graph showing the speed of the intermediate transfer belt at the time of color switching in the second prior art.
Figure 22:
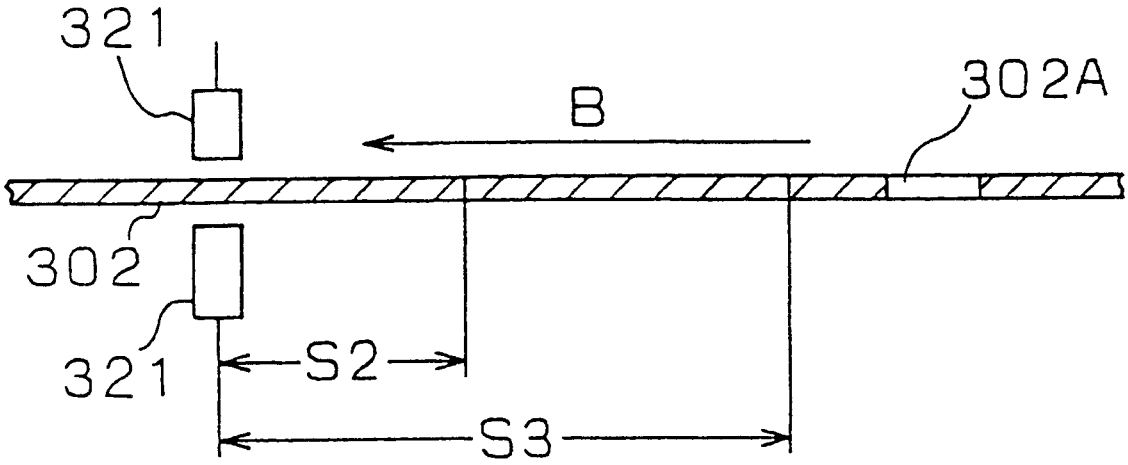
FIG. 22 (PRIOR ART)
FIG. 22 is the side cross-sectional view showing the position detection section of the intermediate transfer belt in the prior art.
Figure 23:
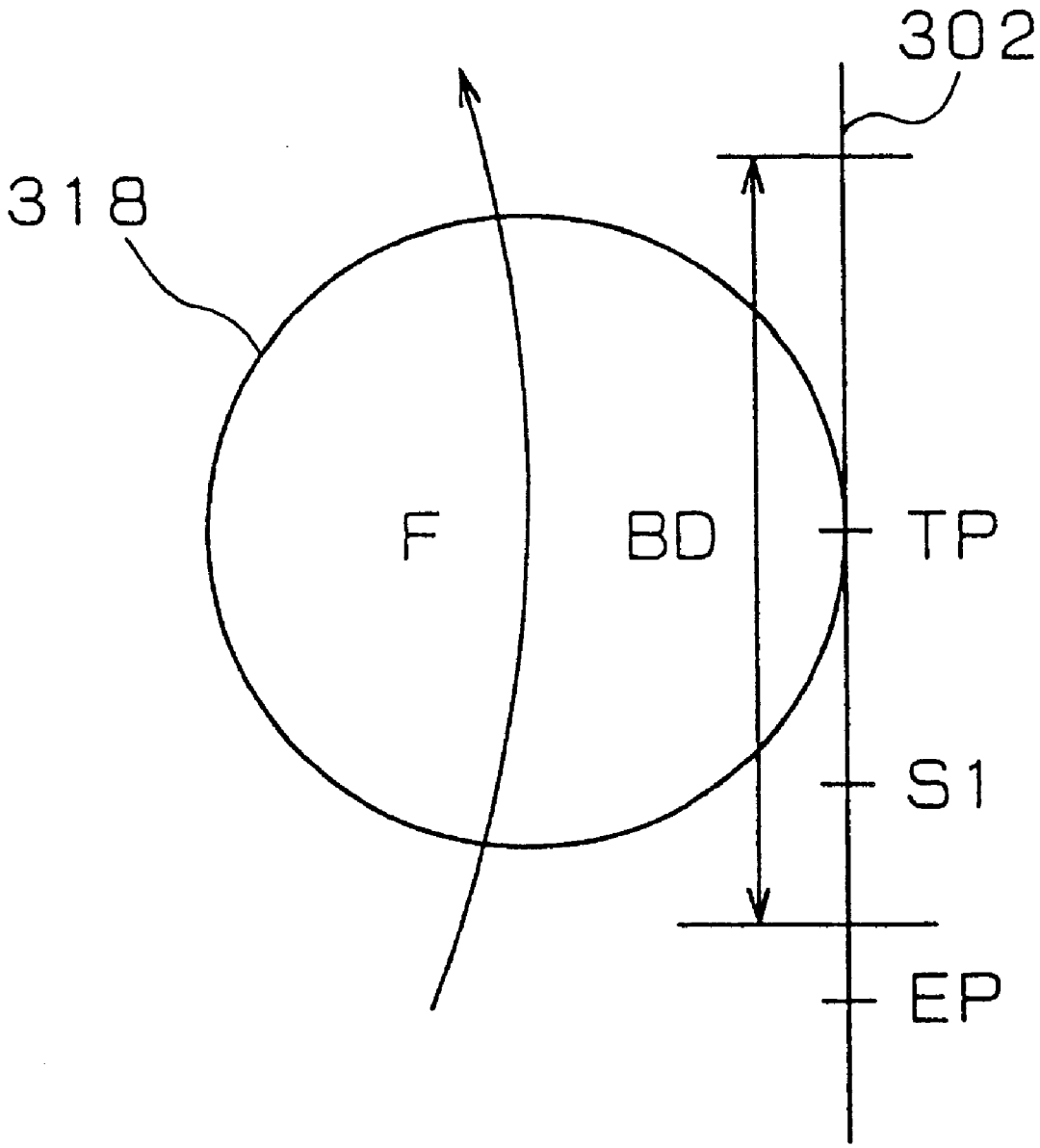
FIG. 23 (PRIOR ART)
FIG. 23 is the schematic view showing the arrangement of the primary transfer section of the color image forming apparatus of the second prior art.

A color image forming apparatus according to the seventh embodiment of the present invention will be described with reference to FIG. 18. FIG. 18 is a side view showing relevant parts of the color image forming apparatus according to the seventh embodiment of the present invention. In FIG. 18, the developer unit 71 is provided for each of yellow, magenta, cyan and black. A photoconductor belt 80 is a metal-made endless belt having a photoconductive layer thereon. The length of the photoconductor belt 80 is 377 mm. A transfer roller 81 transfers the color toner images formed on the photoconductor belt 80 onto the recording paper 64. A photoconductor cleaner 82 has a cleaning blade 83. Like the cleaner 51 of FIG. 1, the cleaning blade 83 is disposed so that it can be separated from and come into contact with the photoconductor belt 80 with the drive roller 55A of the photoconductor belt 80 as a backup member. Every time the photoconductor belt 80 rotates once, the toner image of one color is formed on the photoconductor belt 80, and the toner images of a plurality of colors are formed by superimposing on the photoconductor belt 80. The formed toner image is transferred from the photoconductor belt 80 to the recording paper 64 by the transfer roller 81. The drive roller 55A and the driven rollers 55C and 55D of the photoconductor belt 80 have an outside diameter of 30 mm, and are supported by a side plate (not shown) of the body of the apparatus. This arrangement is the same as that of the drive roller 55A and the driven rollers 55C and 55D about which the intermediate transfer belt 50 is supported in the first embodiment.

Designating other elements that are similar to those of the first embodiment the same reference numerals as those of FIG. 1, the operation of this embodiment will be described.

First, the image forming process is started by use of the yellow developer unit 71Y situated at the image formation position 10 which is opposed to the photoconductor belt 80. The developer unit 71Y and the charger 34 start to operate simultaneously with the start of rotation of the photoconductor belt 80. The photoconductor belt 80 rotates in the direction of the arrow by a frictional force driven by the drive roller 55A. At this time, the transfer roller 81 and the photoconductor cleaner 82 are separated from the photoconductor belt 80.

An electrostatic latent image is formed on the photoconductor belt 80 so as to be aligned with the image writing start position on the photoconductor belt 80. A yellow toner image is formed on the photoconductor belt 80 by developing the electrostatic latent image by the developer unit 71Y. The toner image is carried on the photoconductor belt 80. The yellow image formation is ended when the rear end of the image is transferred, and the photoconductor belt 80 is returned and stopped at its initial position. At this time, the image front end Top has passed the cleaning position K, and the image rear end End is situated upstream from the cleaning position K.

When the yellow image formation is finished, the carriage 2 rotates 90 degrees in the direction of the arrow, so that the yellow developer unit 71Y is moved from the image formation position, and the magenta developer unit 71M is placed in the image formation position. When the carriage 2 stops, the photoconductor belt 80 starts to operate, and magenta toner image formation is performed in a manner similar to the yellow image formation. Consequently, yellow and magenta toner images are formed so as to be aligned and superimposed on the photoconductor belt 80.

The above-described operation is repeated for cyan and black, so that toner images of the four colors are formed so as to be superimposed on the photoconductor belt 80. During the latent image formation of the black toner image, after the rear end of the toner image in which the yellow, magenta and cyan toner images are superimposed passes the secondary transfer position S, the transfer roller 81 is moved and pressed against the photoconductor belt 80 before the front end of the toner image where the black toner image is also superimposed reaches the secondary transfer position S. Then, the recording paper 64 sent out in accordance with the timing for the front end of the toner image to reach the transfer position is conveyed by being held between the transfer roller 81 and the photoconductor belt 80, and the four-color toner image is transferred onto the recording paper 64.

Moreover, during the latent image formation of the black toner image, after the rear end of the toner image where the yellow, magenta and cyan toner images are superimposed passes the cleaning position K, the photoconductor cleaner 82 is moved and pressed against the photoconductor belt 80 before the front end of a residual toner image after the transfer reaches the cleaning position K. Thereby, the toner remaining on the photoconductor belt 80 after the secondary transfer is scraped by the cleaning blade 83. Since the distance between the cleaning position K and the exposure position E of the photoconductor belt 80 is smaller than the image length, the formation of the latent image of the last color has not been finished yet when the photoconductor cleaner 82 is pressed.

When only one sheet of image is formed, after the transfer is finished, the photoconductor belt 80 is stopped, and the transfer roller 81 and the photoconductor cleaner 82 are separated from the photoconductor belt 80. Then, the yellow developer unit 71Y is returned to the image formation position 10, and the color image formation is completed.

When images are continuously formed, with the photoconductor cleaner 82 and the transfer roller being pressed against the photoconductor belt 80, image formation of the first color of the next image is performed by the black developer unit 71BK situated at the image formation position 10, and a black toner image is formed at a position on the photoconductor belt 80 where the previous image was formed. Then, the photoconductor cleaner 82 and the transfer roller 81 are separated from the photoconductor belt 80 before the front end of the toner image of the first color, black, reaches the secondary transfer position S. After the black image is formed, the developer unit situated at the image formation position 10 is switched from the black developer unit 71BK to the yellow developer unit 71Y, and image formation is performed. By superimposing images of the next and succeeding colors on the photoconductor belt 80 by repeating the above-described operation, a color image is obtained.

Other materials and workings of the process elements are similar to those of the first embodiment.

In the seventh embodiment, since the latent image formation by exposure and cleaning of the photoconductor belt 80 are simultaneously performed, a problem is the difference in running speed (rotation period) of the photoconductor belt 80 between when the photoconductor cleaner 82 is pressed against the photoconductor belt 80 and when the photoconductor cleaner 82 is separated therefrom. The smaller the difference is, the more excellent the reproducibility of the running of the photoconductor belt 80 is, so that excellent images are obtained in which there is no positional shit.

In the seventh embodiment, a metal belt having a low friction factor compared with resin or robber is used as the base material of the photoconductor belt 80, and the photoconductor cleaner 82 is pressed with the drive roller 55A as a backup member. Consequently, the reproducibility of the rotation of the photoconductor belt 80 during image formation is secured, so that excellent images are obtained in which there is no positional shift. Moreover, since cleaning is performed while latent images are being formed, the peripheral length of the photoconductor belt 80 can be minimized, so that the size of the apparatus can be reduced and the throughput can be improved.

As described above, according to the seventh embodiment, the length of the photoconductor belt 80 from the exposure position E to the cleaning position K with the drive roller 55A as a backup member is shorter than the image length. Consequently, the peripheral length of the photoconductor belt 80 can be minimized, so that the size of the apparatus can be reduced and the throughput can be improved. As a result, excellent images are obtained in which there is no image shift.

In the seventh embodiment, the photoconductor belt 80 and the drive roller 55A, etc. are fixed to the body of the apparatus. As another arrangement, the photoconductor belt 80, the driven rollers 55C and 55D and the drive roller 55A may be integrated into a unit which is detachable from the body of the apparatus like the transfer belt unit shown in the first embodiment. Thereby, maintenance such as replacement of the photoconductor belt 80 and disposal of the waste toner is facilitated.

In the description given above, the drive roller 55A is made of aluminum, and the photoconductor belt is made of polycarbonate. Since the slip amount of the photoconductor belt depends on the frictional force between the belt-form image former for superimposing toner images and the drive roller 55A, the materials are not limited to the above-mentioned ones. Excellent results are obtained by using a material where the average friction factor of the entire contact surfaces of the belt-form image carrier and the drive roller 55A is not less than 0.1 and not more than 0.45.

In the above description, the drive roller 55A is made of aluminum as a preferred material. However, it may be made of an alloy such as stainless steel. Metals have high rigidity, and metal-made rollers do not flex much, even if their diameters are small. Therefore, metals are suitable for reducing the size of the apparatus. Further, the use of a metal with a low specific gravity such as aluminum reduces the overall weight of the apparatus and the weight of the belt unit. Since the use of a metal reduces the friction factor compared with the use of resin or rubber, the positional shift is restrained with an inexpensive and simple arrangement, so that excellent images are obtained.

The tension applied to the belt-form image carrier is 3 kgf. However, in order to prevent the slip with the drive roller 55A, it is preferable that the tension be not less than 1 kgf. Moreover, in order to prevent creep of the belt-form image carrier and flexion of the rollers 55A, 55C ad 55D, it is preferable that the tension be not more than 5 kgf. Therefore, it is preferable that the tension be set within a range of not less than 2 kgf and not more than 4 kgf.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. An image forming apparatus, comprising:

a belt-form image carrier for forming a toner image of a different color on a periphery thereof every rotation so as to be aligned;

a drive member for rotating said belt-form image carrier supported thereby;

a driven member for entraining said belt-form image carrier, said drive member being rotatable by rotation of said belt-form image carrier; and cleaning means disposed so as to be separable from and contactable with said belt-form image carrier, and after start of formation of a first toner image onto said belt-form image carrier, said cleaning means being placed in a cleaning position in contact with said belt-form image carrier from a separated position from said belt-form image carrier before completion of formation of a toner image of a last color onto said belt-form image carrier, wherein a surface of said drive member comes into contact with said belt-form image carrier and has a surface roughness of not more than Ra6.3$\mu$m.

2. A belt unit detachable from an image forming apparatus, said belt unit comprising:

a belt-form image carrier for forming a toner image of a different color on a periphery thereof every rotation so as to be aligned;

a drive member for rotating said belt-form image carrier supported thereby;

a driven member for entraining said belt-form image carrier, said driven member being rotatable by rotation of said belt-form image carrier; and cleaning means disposed so as to be separable from and contactable with said belt-form image carrier, and after start of formation of a first toner image onto said belt-form image carrier, said cleaning means being placed in a cleaning position in contact with said belt-form image carrier from a separated position from said belt-form image carrier before completion of formation of a toner image of a last color onto said belt-form image carrier, wherein a surface of said drive member comes into contact with said belt-form image carrier and has a surface roughness of not more that Ra6.3$\mu$m.

* * * * *